United States Patent [19]

Ohwada et al.

[11] Patent Number: 5,021,774

[45] Date of Patent: Jun. 4, 1991

[54] METHOD AND CIRCUIT FOR SCANNING CAPACITIVE LOADS

[75] Inventors: Jun-ichi Ohwada, Hitachi; Masaaki Kitajima; Masayoshi Suzuki, both of Hitachiohta; Masaru Takabatake; Yoshiharu Nagae, both of Hitachi, all of Japan

[73] Assignee: Hitachi, Ltd., Tokyo, Japan

[21] Appl. No.: 463,823

[22] Filed: Jan. 17, 1990

Related U.S. Application Data

[63] Continuation of Ser. No. 142,870, Jan. 11, 1988, abandoned.

[30] Foreign Application Priority Data

Jan. 9, 1987 [JP] Japan ..... 62-1639
Mar. 6, 1987 [JP] Japan ..... 62-50077

[51] Int. Cl.[5] ..... G09G 3/00

[52] U.S. Cl. ..... 340/811; 340/719; 340/784

[58] Field of Search ..... 340/718, 719, 783–788, 340/805, 811; 350/331 R, 332, 333, 341

[56] References Cited

U.S. PATENT DOCUMENTS

| | | | |
|---|---|---|---|
| 4,110,662 | 8/1978 | Greeneich et al. | 340/719 |
| 4,261,650 | 4/1981 | Sprokel | 350/341 |
| 4,582,395 | 4/1986 | Morozumi | 340/784 |
| 4,716,403 | 12/1987 | Morozumi | 340/784 |
| 4,723,839 | 2/1988 | Nakanowatari et al. | 350/341 |
| 4,724,433 | 2/1988 | Inoue et al. | 340/805 |
| 4,830,467 | 5/1989 | Inoue et al. | 340/805 |
| 4,870,399 | 9/1989 | Carlson | 340/719 |

FOREIGN PATENT DOCUMENTS

| | | |
|---|---|---|
| 56-92573 | 7/1981 | Japan . |
| 57-10467 | 6/1982 | Japan . |
| 2070857 | 12/1980 | United Kingdom . |

OTHER PUBLICATIONS

Liquid Crystal Matrix Displays, (Proceedings of the IEEE, vol. 59, No. 11, Nov., 1971), pp. 1566–1579.

*Primary Examiner*—Jeffery A. Brier
*Attorney, Agent, or Firm*—Kenyon & Kenyon

[57] ABSTRACT

A high-speed scanning method uses a K(K≧3)-number of semiconductor switch elements each having a first main electrode responsive to an input signal, a second main electrode, and a control electrode responsive to a control signal for controlling the transmissive and intransmissive states of said input signal from the first main electrode to the second main electrode; and capacitive loads connected respectively with the second main electrode of each of said K-number of semiconductor switch elements, for shifting one of the K-number of semiconductor switch elements sequentially with a predetermined period from the transmissive state to the intransmissive state or vice versa, wherein, the time, for which an arbitary L(K>L≧2)-number of semiconductor switch elements of adjacent scans are rendered transmissive, and the time, for which the L-number of semiconductor switch elements are rendered intransmissive, are included in at least one frame period, to elongate the period for which the scanning signals fluctuate, thereby permitting use of low-frequency semiconductor switches.

12 Claims, 17 Drawing Sheets

METHOD AND CIRCUIT FOR SCANNING CAPACITIVE LOADS

This application is a continuation of application Ser. No. 07/142,870, filed Jan. 11, 1988, now abandoned.

BACKGROUND OF THE INVENTION

The present invention relates to a scanning method and a scanning circuit and, more particularly, to a scanning method and a scanning circuit which use a display element of a liquid crystal or the like and are suitable for an active matrix type display having a driver built therein.

The so-called "active matrix display", which is formed on a substrate of glass or the like with switching elements such as thin film active elements, e.g., diodes or thin film transistors (which will be referred to as the "TFTs" for brevity) and which are combined with a substance having an electro-optical effect such as a liquid crystal, is featured by capability of forming a large-area, high-fineness and high-quality display. In addition, the display using the TFTs constitutes a driver of the TFTs so that it forms on the glass substrate not only a display unit but also a circuit for driving the display unit to reduce the number of connecting lines from the outside and the number of external drivers. This makes it possible to drop the production cost and to prevent the reliability from dropping due to inferior connection. Thus, many displays having the driver built therein are proposed in Japanese Patent Laid-Opens Nos. 56 - 92573 and 57 - 100467 and so on since they have been proposed in Proceedings of IEEE, 59, P1566 (1971). These circuit structures can constitute a signal circuit for generating a signal voltage to be applied to the wiring at a signal (or data) side, of a smaller number of TFT elements per line but still has room for improvements in the following points. First of all, the voltage applied to the signal electrode (or data line) of the display unit has its signal voltage applied to the signal electrode through a TFT element at the output step of a driver, when the TFT element is on. When the TFT element is then turned off, the voltage is held by the capacitor Cl of the signal electrode. These operations are accomplished for a period, in which one of the scanning lines is selected so that a scanning voltage for turning on the TFT element of the display unit is applied to the scanning electrode. This makes it necessary for the voltage applied to the signal electrode for that period to be held till the end of the scanning period of the one line. If the insulating resistance of the signal electrode to another unit is insufficient, the voltage applied to the signal electrode capacitor till the end of the scanning period is released so that the voltage applied to the TFT of a pixel unit drops. As a result, each pixel connected with that signal electrode has an uneven luminance for each signal electrode because the applied voltage is always low. In order to prevent this, the TFT element at the output step of the driver should be held on till the end of the scanning period of one line so that an electric current may be supplied to an extent corresponding to the discharge of the voltage from the signal electrode.

Next, it is necessary to consider the problems of the ON characteristics of the TFT elements of the display unit and the output step. As the display is of a higher capacity, i.e., a larger display area and more scanning lines, the scanning periods of one line and one pixel become shorter. Since the electrostatic capacity per line becomes higher, on the contrary, a relatively higher electrostatic capacitive load has to be charged up for a short period for either a so-called "sequential dot scanning method", by which signal lines are sequentially scanned by one signal line for one scanning period, or a scanning method of sequentially scanning by a plurality of signal lines (the latter method will be called the "sequential block scanning method by making one block of a plurality of lines to be once scanned). The TFT element at the output step of the driver should also have a high mutual drain conductance gm. According to the aforementioned scanning methods, moreover, the ON voltage of the TFT elements of the display unit are so reduced that an insufficient voltage is applied to the liquid crystal and the contrast ratio of the display is reduced. This makes it necessary to enlarge the channel width W of the TFT elements to thereby increase the mutual conductance gm. As a result, the circuit area is increased, and the ratio occupied by the display electrode of the display unit is reduced together with the display characteristics. In order to avoid this, the so-called "sequential line scanning method", by which the TFT element of the display unit is turned on for the substantially whole address period of one scanning line with the signal voltage being applied, is desired as the driving method.

Next, the structure of a built-in driver or a driver at a signal side (or data voltage generating side) is required to have high-speed operations so that care should be taken with regard to the circuit design. If the number of the pixels of the display unit of a display is assumed to be expressed by N (i.e., the number of vertical pixels) $\times$M (i.e., the number of horizontal pixels) and if the frequency for rewriting one frame (which will be called the "frame frequency") is denoted at $f_F$(Hz), for example, the maximum frequency $f_{max}$ of a signal voltage inputted to the display is calculated by $N \times M \times f_F$. With the pixel number of the display unit being $N=400$, $M=640 \times 3$ (assuming the display of three colors R, G and B) and $f_F=60$ Hz, for example, the maximum frequency $f_{max}$ takes such a very high value as is expressed by $f_{max}=46.08 \times 106$ Hz$=46.08$ MHz. Since the circuit operating within such frequency band is very difficult to be constructed of TFTs of amorphous or polycrystalline silicon, for example, it is necessary to improve the circuit structure or the signal applying method having characteristics matching the TFT elements. The above-specified example of the prior art is a circuit structure which has been devised to apply input data in parallel to thereby to drop the aforementioned maximum frequency $f_{max}$ with the number of the input data. However, the part for receiving the signals from the outside and the part for applying the input signals to the display unit are of the voltage distribution type resorting to the electrostatic capacity, in which the common TFT elements are used or in which the TFT elements are used as transfer gates. As a result, the example of the prior art requires the TFT elements of the input part to drive a high electrostatic capacitive load so that it is defectively difficult to respond to an input signal of high frequency.

In the aforementioned embodiment, moreover, the timing for applying or the circuit structure for generating the drive voltage such as scanning pulses for operating the TFT elements for processing the input data signals divides the selection period of one scanning line with the number of blocks, each of which is composed of a plurality of signal lines. Since the pulse width of the scanning pulses becomes smaller for a larger frame and the higher fineness, a circuit for generating the scanning pulses is required of high-speed operations.

The prior art thus far described has failed to efficiently process the high-speed input data of a built-in signal driver using TFTs to apply them to the display unit so that it has been troubled in its own operating speed and the display characteristics of the display unit.

SUMMARY OF THE INVENTION

An object of the present invention is to provide a high-speed scanning method and circuit which can use a semiconductor element capable of switching at a relatively low speed even in case input data are at a high rate.

In order to achieve the above-specified object, according to a feature of the present invention, there is provided a scanning method using: a $K(K \geqq 3)$-number semiconductor switch elements each having a first main electrode responsive to an input signal, a second main electrode, and a control electrode responsive to a control signal for controlling the transmissive and intransmissive states of said input signal from said first main electrode to said second main electrode; and capacitive loads connected respectively with the second main electrodes of said K-number of semiconductor switch elements, for shifting one of said K-number of semiconductor switch elements sequentially with a predetermined period from said transmissive state to said intransmissive state or vice versa, wherein the improvement resides in that the period, for which an arbitrary $L(K > L \geqq 2)$-number of semiconductor switch elements of adjacent scans are rendered transmissive, and the period, for which said L-number of semiconductor switch elements are rendered intransmissive, are included in at least one period.

According to another feature of the present invention, there is provided a scanning circuit comprising: a $K(K \geqq 3)$-number of semiconductor switch elements each having a first main electrode, a second main electrode, and a control electrode responsive to either a first potential level or a second potential level different from said first potential level; an input signal source for generating a series of input signals to be applied to a first main electrode of each of said K-number of semiconductor switch elements; a K-number of capacitive loads connected respectively with the second main electrode of each of said K-number of semiconductor switch elements; and a control circuit for shifting the first and second potential levels, which are to be applied to the control electrodes of said K-number of semiconductor switch elements, sequentially with a predetermined period from said first or second potential level to said second or first potential level, respectively, wherein the improvement resides in that said control circuit has in at least one period the period, for which the control electrodes of an arbitrary $L(K > L \geqq 2)$-number of semiconductor switch elements of adjacent scans assume said first potential level, and the time, for which the control electrodes of said L-number of semiconductor switch elements assume said second potential level.

For reducing the scanning frequency, there is established a period for which the individual scanning signals overlap one another. This elongates the period for which the scanning signals fluctuate so that the scanning frequency can be reduced.

BRIEF DESCRIPTION OF THE DRAWINGS

Other objects and features of the present invention will become apparent from the following description taken in connection with the embodiments thereof with reference to the accompanying drawings, in which:

FIG. 9(*b*) illustrates the basic structure of two-way shift registers.

FIG. 9(*c*) illustrates the structure of three-way shift registers.

FIG. 10(*b*) illustrates the structure of a two-way shift register circuit configuration.

FIG. 21(*b*) illustrates signal waveforms to be used in connection with the circuit of FIG. 21(*a*).

FIG. 22(*b*) illustrates signals to be used in connection with the circuit of FIG. 22(*a*).

FIG. 23(*b*) illustrates a switch circuit which can be utilized in the circuit of FIG. 23(*a*).

FIG. 23(*c*) illustrates waveforms of signals to be utilized in connection the circuit of FIG. 23(*a*).

DETAILED DESCRIPTION

Figure 18:
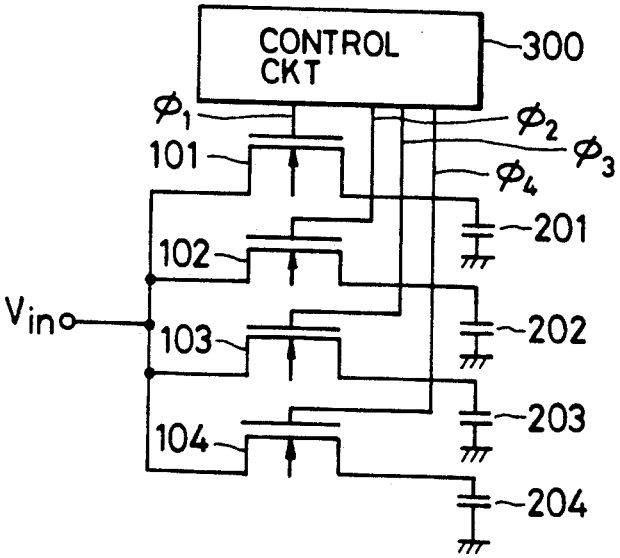
FIG. 18 illustrates a circuit diagram of yet another embodiment of the present invention.

The present invention will be described in the following with reference to FIGS. 18 and 19. FIG. 18 is a circuit diagram for illustrating an aspect of the present invention, and FIG. 19 is a time chart of the circuit of FIG. 18.

In FIG. 18, reference numerals 101 to 104 denote four (K=4) n-channel type MOS transistors exemplifying semiconductor switches, preferably thin film transistors (which will be referred to as the "TFTs"for brevity) formed on a glass substrate (not shown). A first main electrode of each of the TFTs 101 to 104 is commonly responsive to a continuous input signal $V_{in}$ such as analog or digital image signals. A second main electrode of each of the TFTs 101 to 104 is connected with each of capacitive loads 201 to 204, respectively. These capacitive loads 201 to 204 are preferably exemplified by liquid-crystal wiring capacitors or the input gate capacitors of MOS transistors of a next stage. The control electrodes of the TFTs 101 to 104 are made responsive to scanning pulses $\phi_1$, $\phi_2$, $\phi_3$ and $\phi_4$ of first and second potential levels $V_1$ and $V_2$, control signals for controlling the ON and OFF states, in response to which the input signals $V_{in}$ are transferred or not transferred (transmissive or intransmissive) respectively from the first main electrode to the second main electrode. Here, for example, the first potential level $V_1$ is at the ground potential (at 0 V), and the second potential level $V_2$ is at the supply potential (at $V_{cc}$=5 V).

Figure 19:
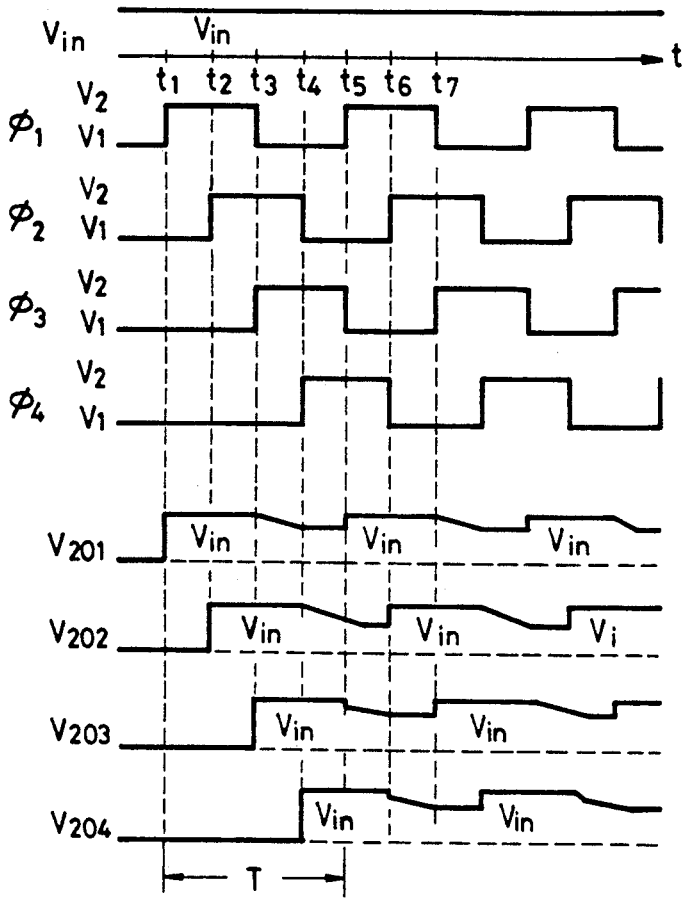
FIG. 19 discloses driving signals used to drive the circuit of FIG. 18.

In FIG. 19, at a time $t_1$, the pulse signal $\phi_1$ changes from the level $V_1$ to level $V_2$, and the TFT 101 goes from the OFF state to the ON state so that the input signal $V_{in}$ is applied, as the voltage $V_{201}$ of the capacitive load 201, to the capacitive load 201.

At a time $t_2$, the pulse signal $\phi_1$ remains at the level $V_2$ so that the, TFT 101 is held in the ON state. At this time, the pulse signal $\phi_2$ changes from the level $V_1$ to the level $V_2$, and the TFT 102 goes from the OFF state to the ON state so that the input signal $V_{in}$ is applied, as the voltage $V_{202}$ of the capacitive load 202, to the capacitive load 202.

At a time $t_3$, the pulse signal $\phi_1$ changes from the level $V_2$ to the level $V_1$, and the TFT 101 goes from the ON state to the OFF state so that the capacitive load 201 holds the value of the input signal $V_{in}$ received during the just preceding ON state of the TFT 101 for a predetermined period. At this time, that value may slightly drop due to the presence of a leakage resistance. The pulse signal $\phi_2$ is remains at the level $V_2$ so that the TFT 102 remains in the ON state. For the period from the time $t_2$ to the time $t_3$, more specifically, the pulse signal $\phi_1$ and $\phi_2$ of adjoining scans are at the level $V_2$, and the two (L=2) TFTs 101 and 102 are in the ON state so that the input signal $V_{in}$ is applied to the two. At the same time, the pulse signal $\phi_3$ and $\phi_4$ are at the level $V_1$, and both the TFTs 103 and 104 are in the OFF state. At the time $t_3$, on the other hand, the pulse signal $\phi_3$ changes from the level $V_1$ to the level $V_2$, and the TFT 103 goes to the ON state so that the input signal $V_{in}$ is applied, as the voltage $V_{203}$ of the capacitive load 203, to the capacitive load 203.

At a time $t_4$, the pulse signal $\phi_1$ is unchanged and remains at the level $V_1$, and the TFT 101 holds the OFF state. The pulse signal $\phi_2$ changes from the level $V_2$ to the level $V_1$, and the TFT 102 transfers from the ON state to the OFF state so that the capacitive load 202 holds the value of the input signal received in the just preceding ON state of the TFT 102 for a predetermined period. The pulse signal $\phi_3$ is unchanged and remains at the level $V_2$, and the TFT 103 maintains the ON state. The pulse signal $\phi_4$ changes from the level $V_1$ to the level $V_2$, and the TFT 104 transfers from the OFF state to the ON state so that the input signal $V_{in}$ is applied, as the voltage $V_{204}$ of the capacitive load 204, to the capacitive load 204.

For the period from the time $t_3$ to the time $t_4$, more specifically, the pulse signal $\phi_2$ and $\phi_3$ are at the level $V_2$, and the two (L=2) TFTs 102 and 103 of adjacent scans are in the ON state. On the other hand, both the pulse signal $\phi_1$ and $\phi_4$ of adjacent scans are at the level $V_1$, and both the TFTs 101 and 104 are in the OFF state.

At a time $t_5$, the pulse signal $\phi_1$ vary from the level $V_1$ to the level $V_2$ as at the time $t_1$. For the period from the instant $t_4$ to the time $t_5$, the pulse signal $\phi_1$ and $\phi_2$ of adjacent scans are at the level $V_1$, and the two (L=2) TFTs 101 and 102 are in the OFF state. At the same time, both the pulse signal $\phi_3$ and $\phi_4$ are at the level $V_2$, and the two TFTs 103 and 104 are in the ON state. Similar operations are repeated on and on at times $t_6$, $t_7$ and so on.

The time from the time $t_1$ to the time $t_5$ is one period, for which the scanning signals $\phi_1$ to $\phi_4$ vary sequentially from the level $V_1$ to the level $V_2$ so that the TFTs 101 to 104 transfer sequentially from the OFF state to the ON state. For this one period, moreover, the scanning signals $\phi_1$ to $\phi_4$ vary sequentially from the level $V_2$ to the level $V_1$ so that the TFTs 101 to 104 transfer sequentially from the OFF state to the ON state. Incidentally, in FIG. 19, the durations of the time from the time $t_1$ to the time $t_2$, from the time $t_2$ to the time $t_3$, from the time $t_3$ to the time $t_4$, and from the time $t_4$ to the time $t_5$ are substantially equal, but may be different.

Since the scanning signals $\phi_1$ to $\phi_4$ thus overlap one another, their respective substantial frequencies are reduced so that they can be produced even if the TFTs 101 to 104 do not have high-speed switching characteristics. In other words, high-speed scanning signals can be produced without varying the switching characteristics of the TFTs 101 to 104.

Incidentally, FIG. 19 presents an example in which K=4 and L=2 so that K=2L. In case K is an odd number, however, it is preferable to set either K=2L−1 or K=2L+1.

Another embodiment of the present invention will be described with reference to FIG. 1.

Figure 1:
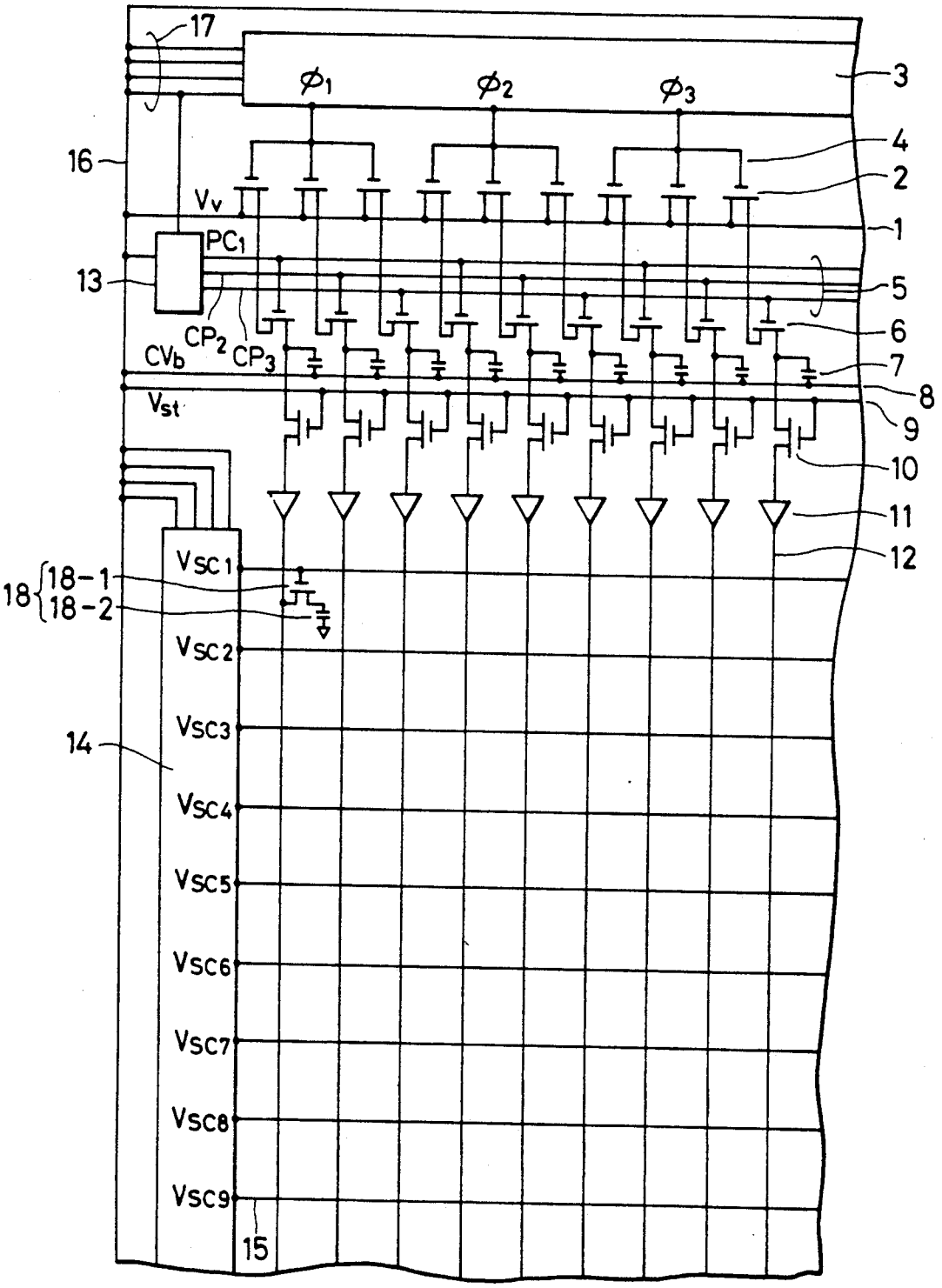
FIG. 1 illustrates a circuit diagram of a first embodiment of the present invention.

FIG. 1 shows a plane type display which is constructed, by TFT elements formed on a transparent insulating substrate 16 made of as glass or plastics, of: a number of pixels 18 of a display unit; a plurality of scanning electrodes 15 for driving the individual pixels; a plurality of signal electrodes 12; a scanning circuit 14; and a signal circuit having the following structure. Each of the pixels 18 is composed of a TFT element 18-1, and an inter-electrode display element 18-2 of a liquid crystal or the like to be driven by the TFT element 18-1.

As a component of the signal circuit, one block is prepared by connecting a TFT element, in which a signal input wire 1 for feeding displaying data signals including video signals for displaying a TV set is connected with a drain electrode (wherein the TFT element is of an n-channel structure having its one input side main electrode called the "drain" and its other output side main electrode called the "source". Structurally speaking, the TFT element can have its source and drain electrodes formed absolutely symmetrically, and hence the source and drain are named merely for illustrative conveniences.), with at least two gate electrodes (which are the three (M=3) control electrodes in FIG. 1). The gate 4 of each of the K-number of blocks is connected with a scanning voltage generator 3 for generating the scanning voltage signals $\phi_1$, $\phi_2$, $\phi_3$, - - - , and so on for scanning the respective blocks. The source electrodes of the TFT elements in the blocks are connected with the drain electrodes of data-sampling TFT elements 6, respectively, which have their gate electrodes connected with a data-sampling wire group 5. The source electrodes of the data-sampling TFTs are connected with data-holding electrostatic capacitors 7 and the drain electrodes of data-transferring TFT elements 10. In the present embodiment, the data-sampling TFTs 6 correspond to the TFT 101 and so on of FIG. 18, and the data-holding electrostatic capacitors 7 correspond to the capacitive loads 201 and so on of FIG. 18. With the source electrodes of the TFT elements 10, there are connected buffers 11 which issue outputs for driving the grouped signal electrodes of the display unit.

The structure of this signal circuit will be classified in terms of its operations: TFT elements 2, the TFT elements 6 and the accompanying signal lines constitute the signal input sampling circuit; the TFT elements 6 and the electrostatic capacitors 7 constitute a hold circuit; the TFTs 10 constitute a data transfer circuit; and the buffers 11 constitute the driver of the display unit.

The circuits 3 and 14 are those for generating a scanning voltage for scanning one block or line sequentially and are constructed essentially of a shift register and, if necessary, a level converter or an output step buffer circuit On the other hand, the buffers 11 are circuits for amplifying or impedance-converting the voltage, which is applied to and held in the electrostatic capacitor existing at its input stage, and for applying the same to the display unit and are constructed of a variety of circuits represented by inverters.

Figure 2:
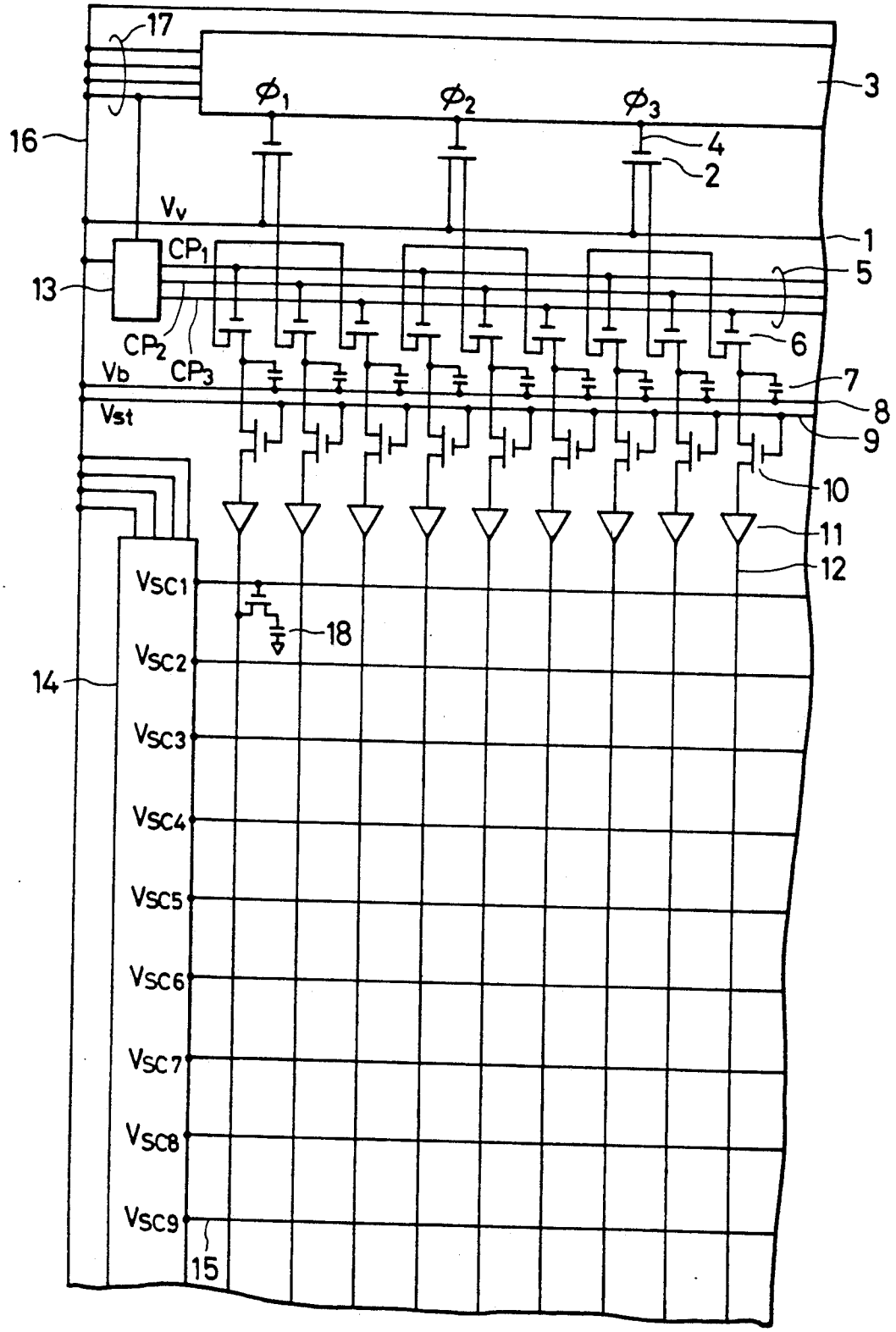
FIG. 2 illustrates a modification of the embodiment of FIG. 1.

FIG. 2 shows a modification of the circuit of FIG. 1. The signal $V_v$ applied to the signal input wire 1 is switched for each block by the single TFT element 2 and is applied to the TFT elements 6. The number of these TFT elements can be reduced to improve the reliability.

Figure 3:
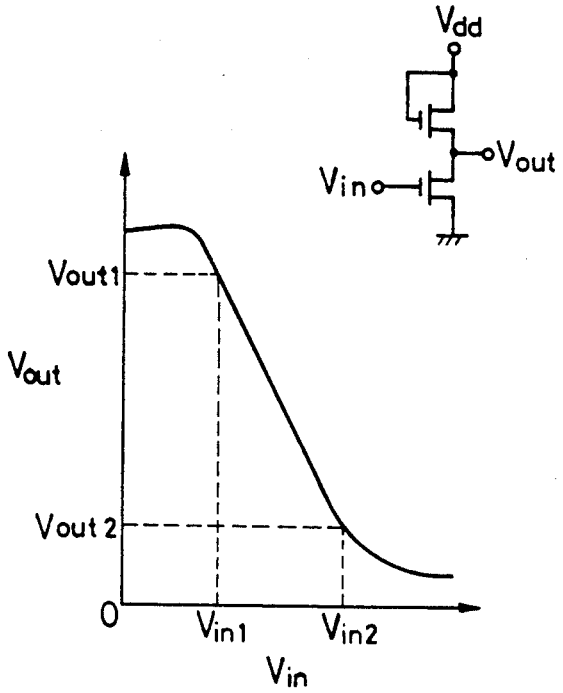
FIG. 3 illustrates current/voltage characteristics of an inverter circuit.

FIG. 3 plots the characteristics of an output voltage $V_{out}$ against the input voltage $V_{in}$ of an inverter circuit. These characteristics correspond to the case of the so-called "E/E type inverter, in which the TFT element is made of polycrystalline silicon and in which the circuit structure of the inverter uses two enhancement type TFTs. There exists a region in which the output voltage $V_{out}$ varies generally linearly with respect to the input voltage $V_{in}$ and which is used as the operating region of the buffer. In the regions of input voltages $V_{in1}$ and $V_{in2}$ of FIG. 2, more specifically, output voltages $V_{out1}$ and $V_{out2}$ linearly vary. The gradient of that portion and the bias voltage value against the input voltage value vary depending upon the characteristics of the TFT element and the circuit design constants such as an inverter ratio, and it is sufficient that the driving conditions be so determined as to set the portion of the linear region as the operating region. Generally speaking, the TFT element is one having the MOS structure, and the gate input impedance is sufficiently high. As a result, the use of the inverter circuit shown in FIG. 3 as the buffers 11 releases none of the charges held in the input portion through the input portion of the buffers 11 so that the signals transmitted from the transfer gates 10 are satisfactorily held.

Figure 4:
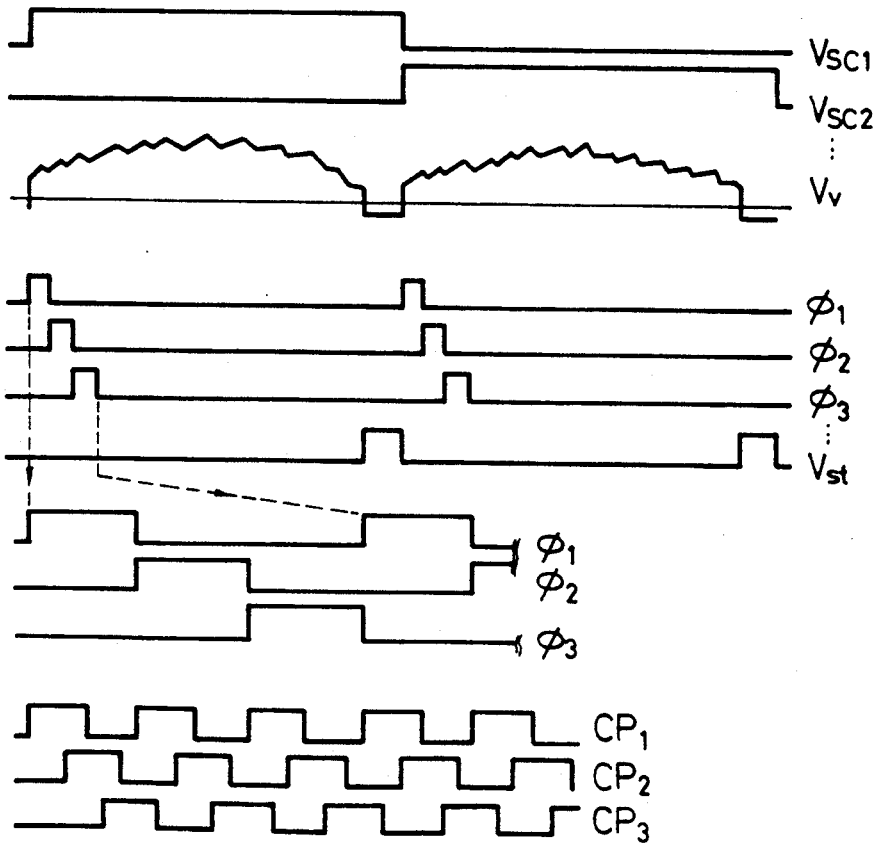
FIG. 4 illustrates driving voltage signals to be applied to the circuits of the embodiment of FIG. 1.

FIG. 4 presents the waveforms of the drive voltages to be applied to the individual portions of FIG. 1. The waveforms belong to scanning voltages $V_{SC1}$, $V_{SC2}$, $V_{SC3}$, - - - , and so on, a video input signal $V_v$ to be applied to the pixel of each scanning electrode, the voltage signals $\phi_1$, $\phi_2$, $\phi_3$, - - - , and so on, clock pulses $CP_1$, $CP_2$ and $CP_3$ to be applied to the gates of the TFT elements 6 for sampling the data from each block, and a voltage $V_{st}$ for transferring the data voltage held in the data-storing electrostatic capacitors 7 to the buffer portion. The video signal $V_v$ is sampled by the electrostatic capacitors 7 when all the voltage signals $\phi_1$, $\phi_2$, $\phi_3$, - - - , and so on and the clock pulses $CP_1$, $CP_2$ and $CP_3$ are applied so that the TFT 2 and TFT 6 are turned on. In case either the TFT 2 or the TFT 6 is turned off, on the contrary, the voltages of the electrostatic capacitors 7 are held. It takes place only once for one scanning line period that both the TFT 2 and the TFT 6 of the combinations of the scanning voltages $\phi$ and the clock pulses CP are turned on. As a result, the video signal $V_v$ is sequentially stored in the electrostatic capacitors at the lefthand side of FIG. 1. It goes without saying that the video signal $V_v$ can be stored from the electrostatic capacitors at the righthand side by inverting the applying direction of the scanning voltages $\phi$ and the applying order of the clock pulses CP. At this time, the characteristics of the TFTs 2 and 6 determine the OFF resistances such that the capacitors 7 are charged up while the clock pulses $CP_1$, $CP_2$ and $CP_3$ are ON and such that the voltages of the capacitors 7 are held for the OFF period. The OFF period assumes its maximum at the signal line of the most lefthand end in the case of FIG. 1 and is substantially equal to one scanning period. The ratio of the ON period and the OFF period is substantially equal to the value of M in the display having the M number of pixels in the horizontal direction. Since the M is about 2,000, for example, the ON/OFF ratio of the TFT elements is sufficient for the charging and holding operations. Next, the voltages to be applied to the input portions of the buffers 11 are determined by the capacitance division of the input capacitors of the capacitors 7 and the buffers 11. Therefore, it is sufficient that the capacitance of the capacitors 7 be set higher than the input capacitance of the buffers. In the embodiment of the prior art having no buffer, the capacitors 7 have had to take a larger value than that of the electrostatic capacitors attached to the signal electrodes so that the TFT 2 and the TFT 6 have found it difficult to charge the capacitors 7 at a high rate. In the present embodiment, on the contrary, the capacitors 7 do not take such high values that they can be charged at a high speed by the TFT 2 and TFT 6.

On the other hand, the outputs of the buffers can apply the voltages to the signal electrodes during the scanning period of about one horizontal line except the fly-back period. Even in case the insulating resistances between the signal electrodes and the scanning electrodes disperse or in case the insulating resistances of the gate insulating films of the TFT elements of the display unit disperse, the currents can be supplied by the buffers so that the voltages of the signal electrodes can be easily held constant to prevent the unevenness of the display.

Moreover, the operating speed of the circuits for generating the scanning voltages $\phi_1$, $\phi_2$ and $\phi_3$ can be dropped by the number of the TFTs 2 in one block, as compared with the case of the sequential dot scanning operation. The embodiments shown in FIGS. 1 and 2 are constructed by using the three TFT elements in one block. The operating frequency of the circuit 3 can be reduced by increasing the number of the TFT elements so that the circuits can be easily built in by the TFT elements.

In the present embodiment, furthermore, the analog signals of the input signals are applied via the single input terminal so that the input signals need not be subjected at the outside to a complicated signal processing such as series/parallel conversions, thus simplifying the circuit structure of the outside.

Figure 5:
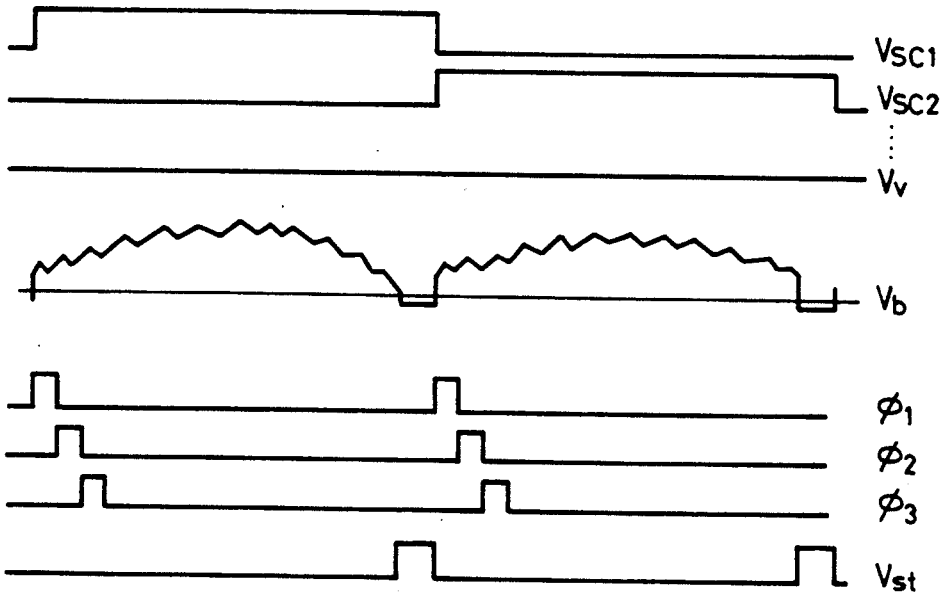
FIG. 5 illustrates a modification of the driving waveforms of FIG. 4.

FIG. 5 presents a modification of the driving waveforms of FIG. 4. In this modification, the DC voltage is applied as the voltage $V_v$, and the video signal voltages are applied to a common wiring 8 of the electrostatic capacitors 7. Since the voltage of the electrostatic capacitors 7 is determined by the voltage difference between the source electrodes of the sampling TFTs 6 and the common wiring 8 so that the voltage similar to that of FIG. 3 (but having its polarity inverted) can be applied to the capacitors 7.

Figure 6:
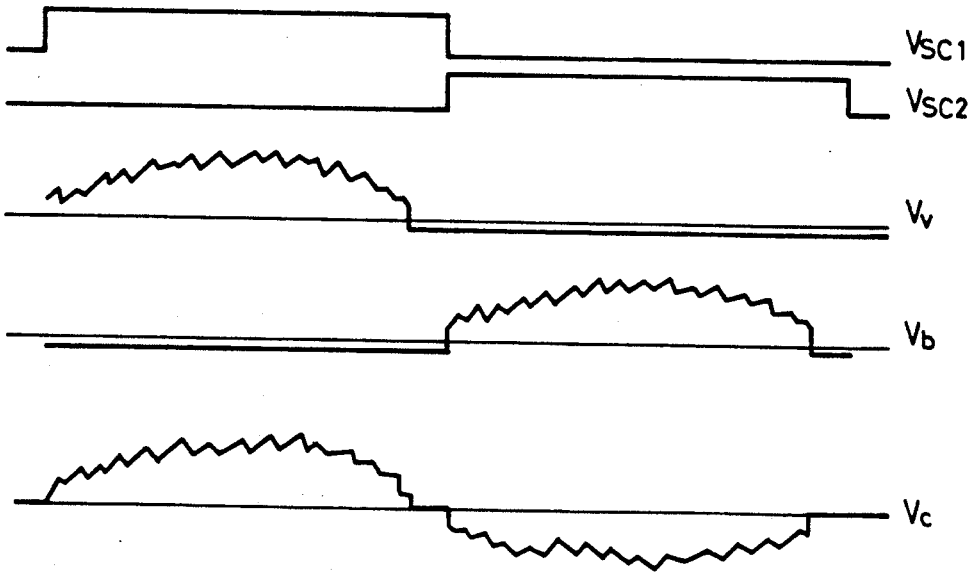
FIG. 6 illustrates yet a further modification of the waveforms of FIG. 4.

FIG. 6 presents a modification of the waveforms of FIGS. 4 and 5. In case a liquid crystal such as a twisted nematic (TN) liquid crystal is to be driven, the driving voltages are alternating so that waveforms having a reduced DC component have to be applied. In the display using the TFTs, the applied voltage to each pixel has to have its positive and negative polarities inverted for each frame. As this inverting method, there has been proposed a method of inverting the polarities of the signals for each frame or a method of inverting the polarities of the signals for each scanning line. In either method, it is necessary to generate the signal voltages which have polarities inverted around a certain level. FIG. 5 shows an example in which the applied voltages are switched between the voltages $V_v$ and $V_b$ for each scanning line to generate the waveforms so that the voltage difference of the electrostatic capacitors 7 may be inverted for each scanning line. The switching of the voltage voltages $V_v$ and $V_b$ may be caused for each frame. In this case, it is possible to generate voltages which have their polarities inverted for each frame.

Thus, the circuit structure of the present embodiment is featured by the fact that it can easily generate the signal voltages having the input voltages inverted.

Figure 7:
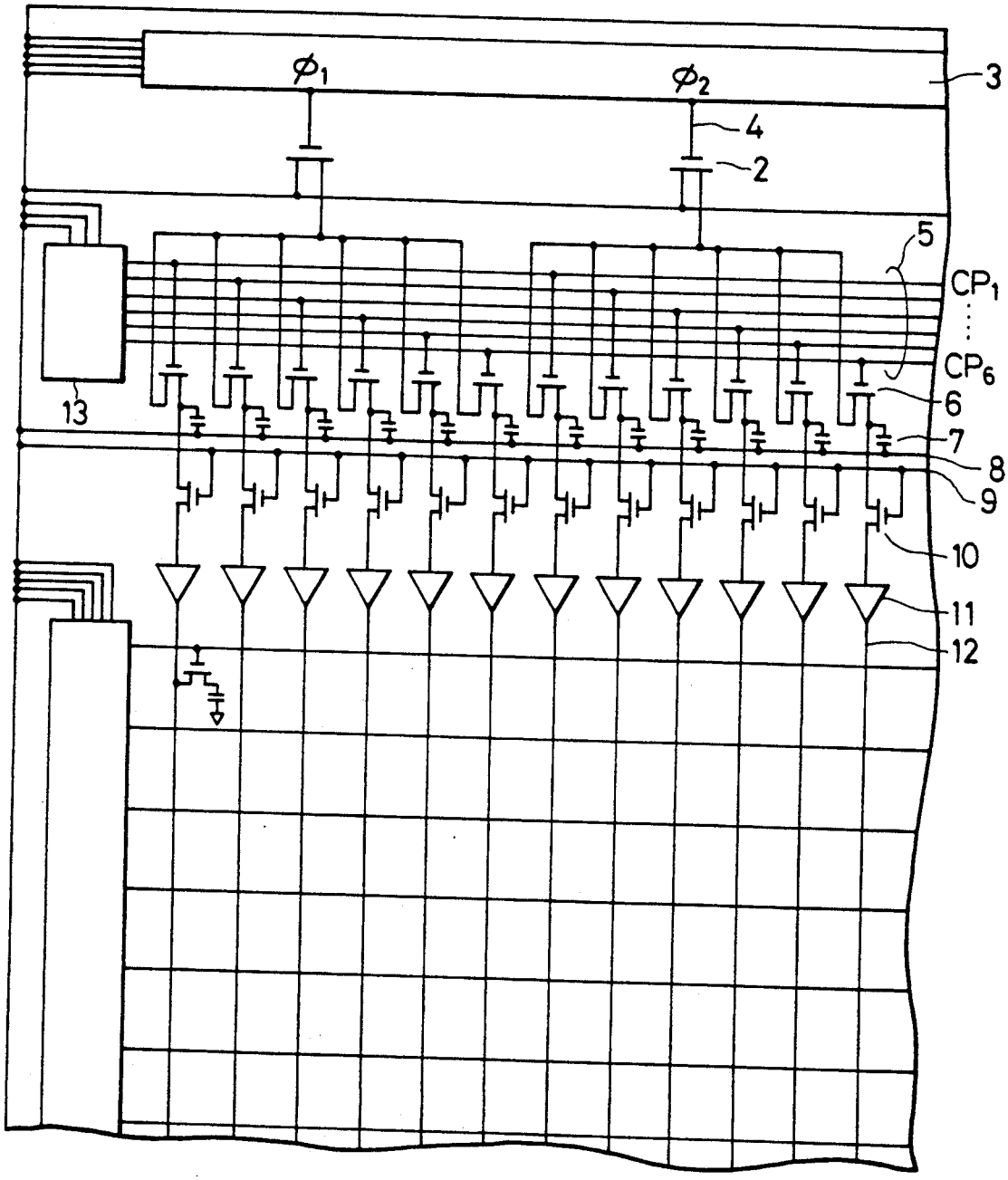
FIG. 7 illustrates a circuit for yet another embodiment of present invention.

FIG. 7 shows a structure of another embodiment of the present invention which is different from that of FIG. 1 or 2 in that the number of the signal lines in one block are doubled to 6 (M=6). As compared with the structure of FIG. 1 or 2, the block scanning voltages $\phi_1$, $\phi_2$, - - - , and $\phi_k$ can reduce their frequencies to one half (with the doubled pulse width). For a larger number of the signal lines in one block, it is possible to realize a lowering of the frequencies of the block scanning voltages $\phi_1$, $\phi_2$, - - - , and so on.

Figure 8:
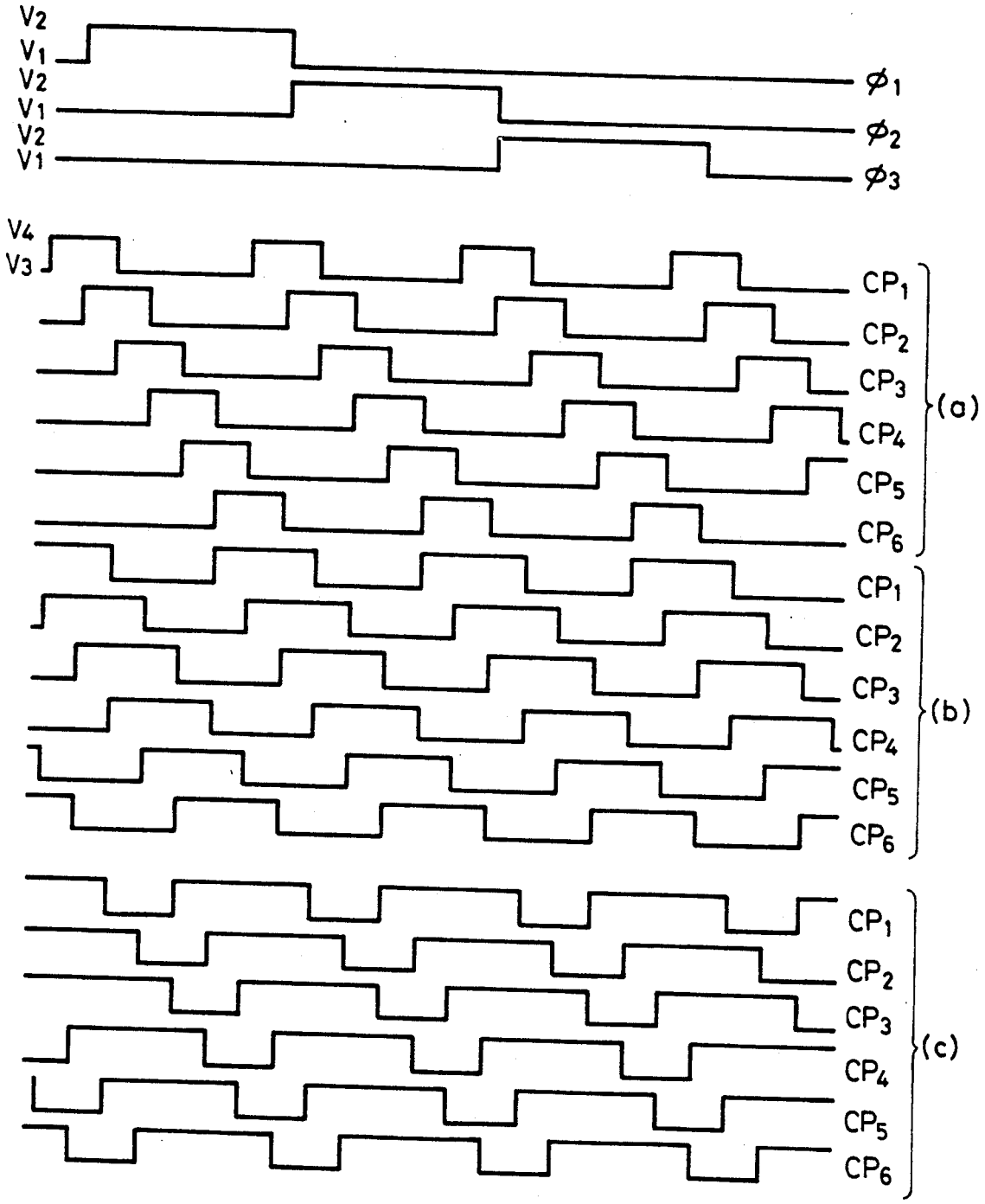
FIG. 8 illustrates the waveforms to be utilized in connection with the circuit of FIG. 7.

Next, in the structure of FIG. 7, the waveforms of the voltages $CP_1$, $CP_2$, - - - , and $CP_6$ corresponding to the sampling voltages $CP_1$, $CP_2$ and $CP_3$ of FIG. 4 are presented in FIG. 8. The embodiment of FIG. 8 is featured by establishing a period for which the adjacent pulses $CP_1$ and $CP_2$, $CP_2$ and $CP_3$, - - - , or $CP_5$ and $CP_6$ overlap each other. Since the voltages to be held at the capacitors 7 connected with the outputs of the TFTs 6 remain at the level as is just before the sampling voltages $CP_1$, $CP_2$ and $CP_3$ assume the level $V_3$ (or preferably the ground potential=0), the sampling voltage $V_4$ (or preferably the supply potential ($V_{cc}$=5 V)) may be applied for the preceding period. In other words, the pulse width of the sampling voltages is enlarged from that of FIG. 8(*a*) to those of FIG. 8(*b*) and 8(*c*). The restrictions upon the operating speed of a data sampling voltage generator 13 are greatly reduced to facilitate the circuit design and to provide room for the characteristics of the TFT elements.

Figure 9A:
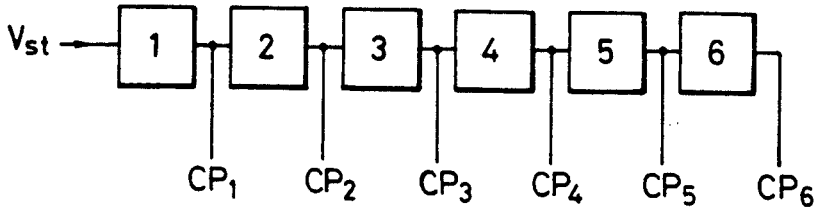
FIG. 9(*a*) illustrates the structure of a shift register circuit.
Figure 9B:
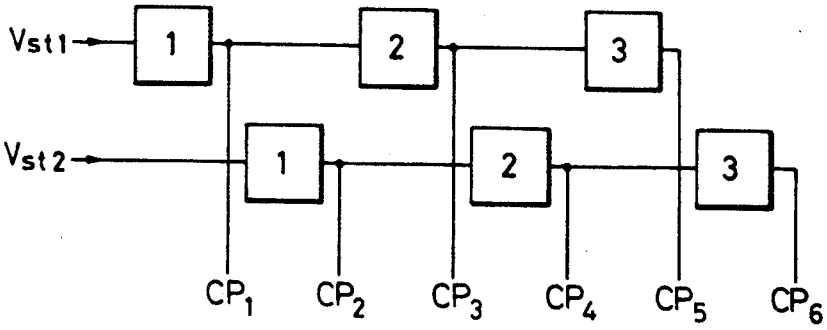
Figure 9C:
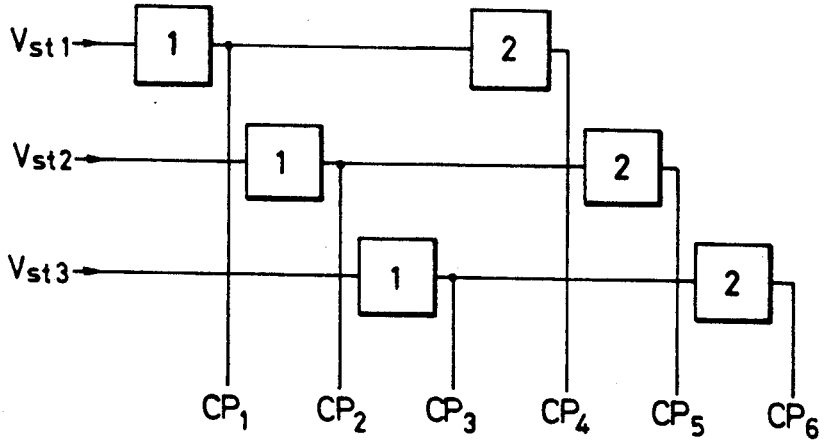

FIG. 9 shows an example of a circuit structure for generating the waveforms presented in FIG. 8. FIG. 9(*a*) corresponds to the structure of an ordinary shift register circuit A six-stage shift register is used for generating the six sampling voltages $CP_1$, $CP_2$, - - - , and $CP_6$. In the structure of FIG. 9(*a*), the input voltage $V_{st}$ may be elongated so as to elongate the output pulses. FIG. 9(*b*) discloses a circuit structure using two-way shift registers. The overlapping sampling voltages $CP_1$, $CP_2$, - - - , and $CP_6$ are generated by shifting the voltages $V_{st1}$ and $V_{st2}$ by a half pulse to operate the individual shift registers with a frequency of one half of that of FIG. 9(*a*). Moreover, FIG. 9(*c*) discloses structure using three-way shift registers. These shift registers can be operated with a frequency of one-third of that of FIG. 9(*a*).

FIG. 9 shows the structures using the shift registers. It goes without saying that similar waveforms can be generated even by using a circuit such as a flip-flop.

Since the sampling voltages can have their frequencies reduced with the driving method and circuit structure thus far described, the circuit can easily be constructed by using the TFTs.

Figure 10A:
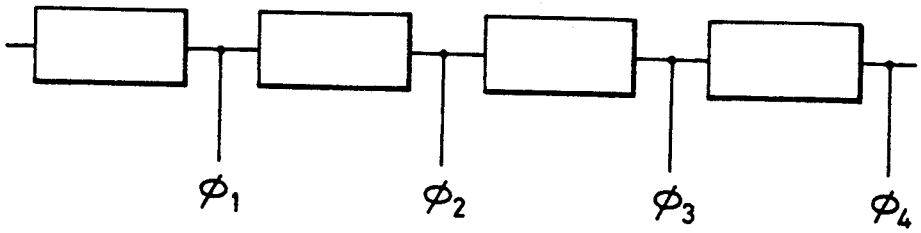
FIG. 10(*a*) discloses a structure of a prior art one-way shift register configuration.
Figure 10B:
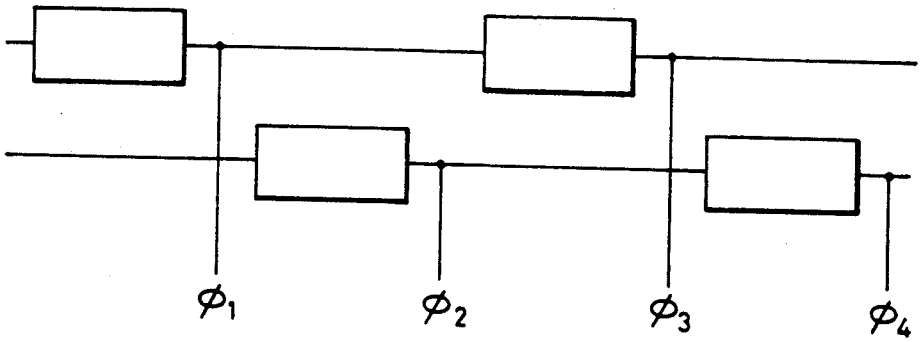

On the other hand, the block scanning voltages $\phi_1$, $\phi_2$, - - - , and so on can also have their pulse widths enlarged, as shown in FIGS. 8(*a*), 8(*b*) and 8(*c*), by a method similar to the aforementioned ones. As shown in FIG. 10, the operating frequency of the shift registers can be reduced by the structure of FIG. 10(*b*) having two-way shift registers, as is different from the structure of FIG. 10(*a*) of the prior art using one-way shift registers.

Figure 20:
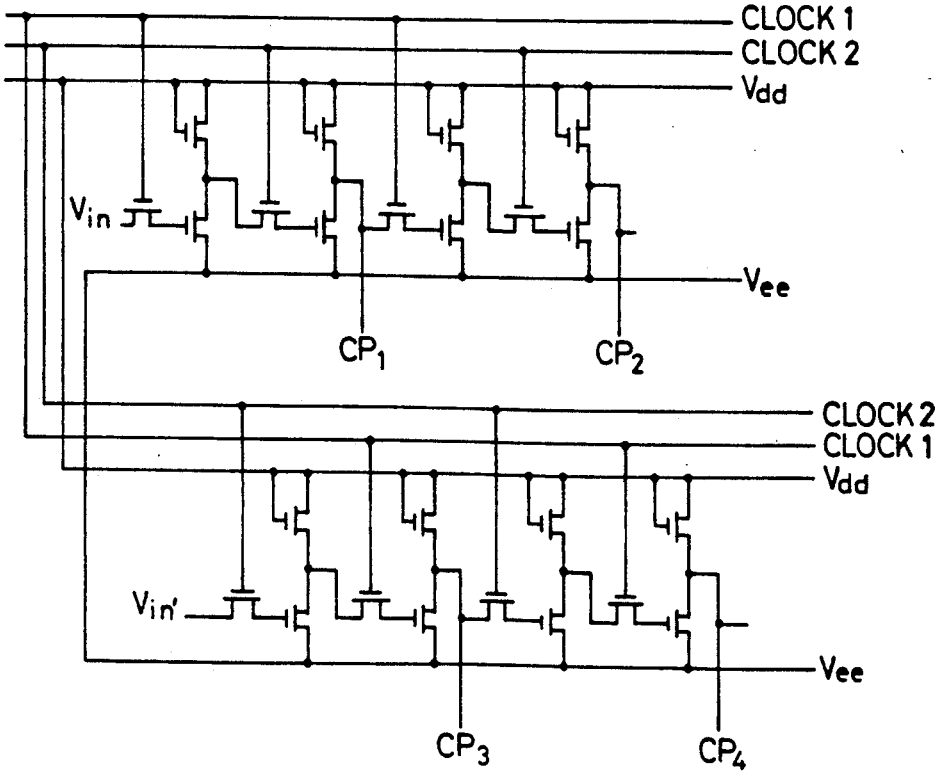
FIG. 20 illustrates an embodiment of a circuit structure for realizing the two-way shift register of FIG. 9(*b*).

FIG. 20 shows one example of the circuit structure for realizing the two-way shift register configuration of FIG. 9(*b*). Waveforms in which the phase of the pulses $CP_1$ and $CP_2$ is shifted from that of the pulses $CP_3$ and $CP_4$ can be produced by providing two stages of shift registers operating with two-phase clocks and by inverting the phases of the clock pulses.

Figure 21A:
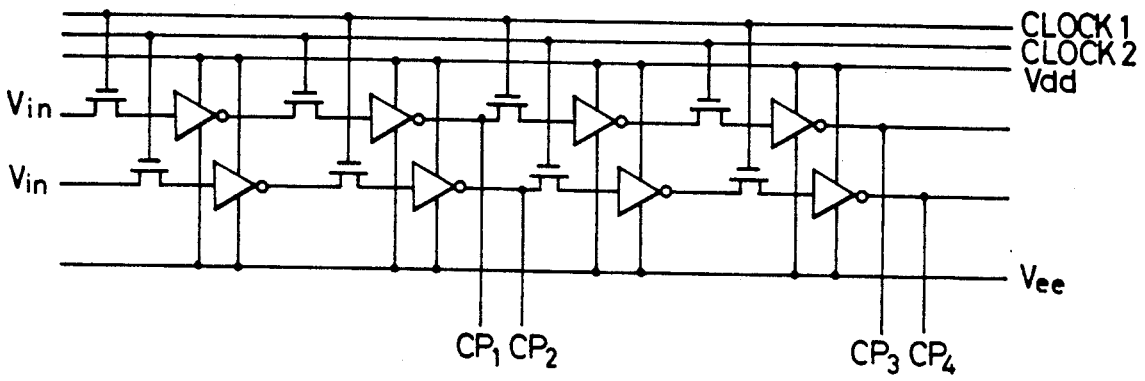
FIG. 21(*a*) illustrates a modification of the circuit of FIG. 20.
Figure 21B:
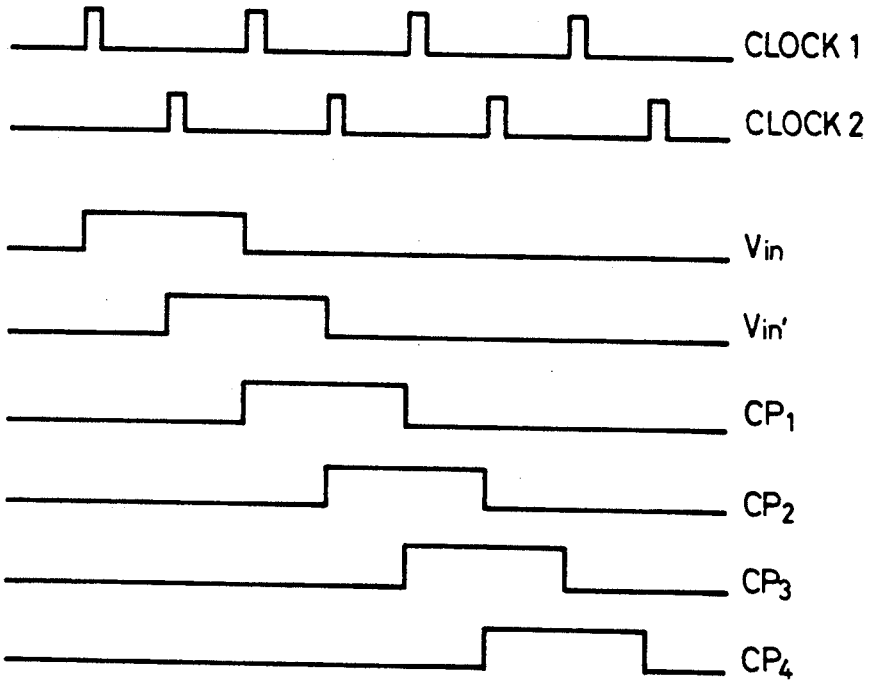

FIG. 21(*a*) shows the same circuit structure as that of FIG. 20, in which the clock lines and the supply lines are made common The waveforms of these circuits are presented in FIG. 21(*b*). In order to obtain the outputs $CP_1$ to $CP_4$, the input signals $V_{in}$ and $V_{in}'$ having their phases shifted by a half phase from the two-phase clocks 1 and 2, are used. The operating frequency of the shift registers can be lowered to one half, as compared with the case in which an array of shift registers is used to generate the outputs $CP_1$ to $CP_4$.

Figure 22A:
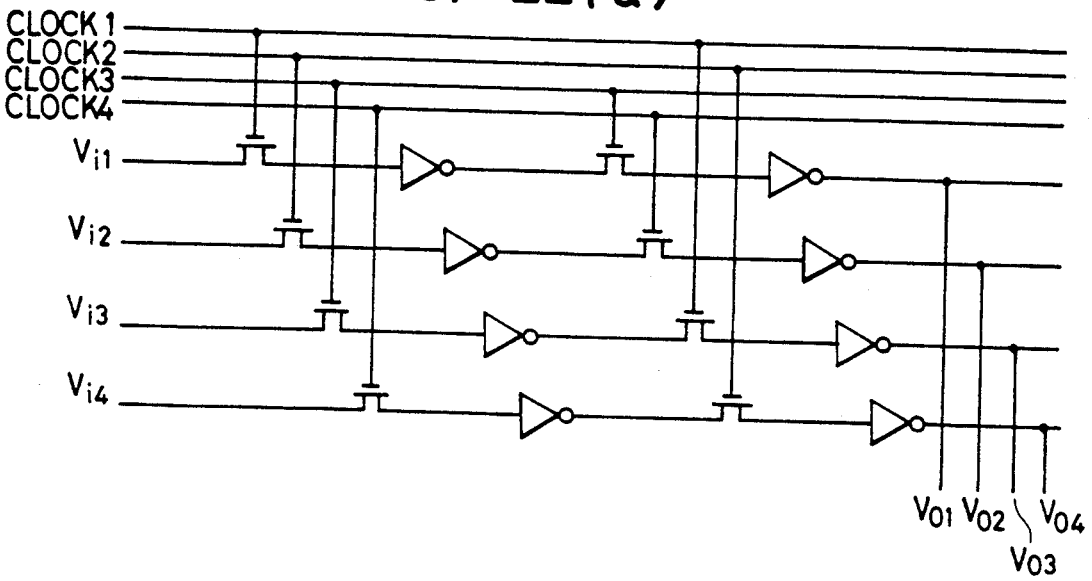
FIG. 22(*a*) illustrates a circuit structure for generating four output signals having shifted phases.
Figure 22B:
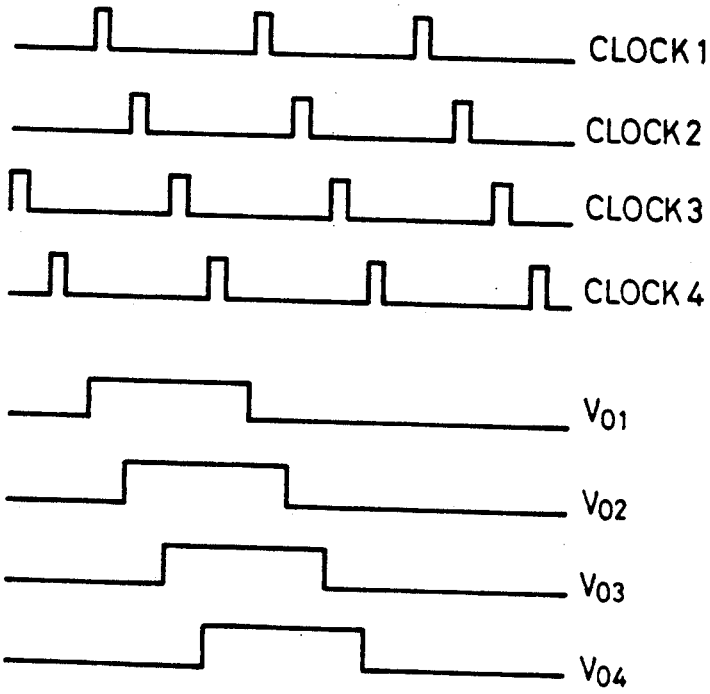

FIG. 22(*a*) showing the structure of a circuit for generating outputs $V_{01}$ to $V_{04}$ having their phases shifted by one quarter by using four-phase clocks and FIG. 22(*b*) discloses a time chart for the circuit of FiG.

22(*a*). In this case, the frequencies can be reduced to one quarter of that of an array of shift registers.

Figure 23A:
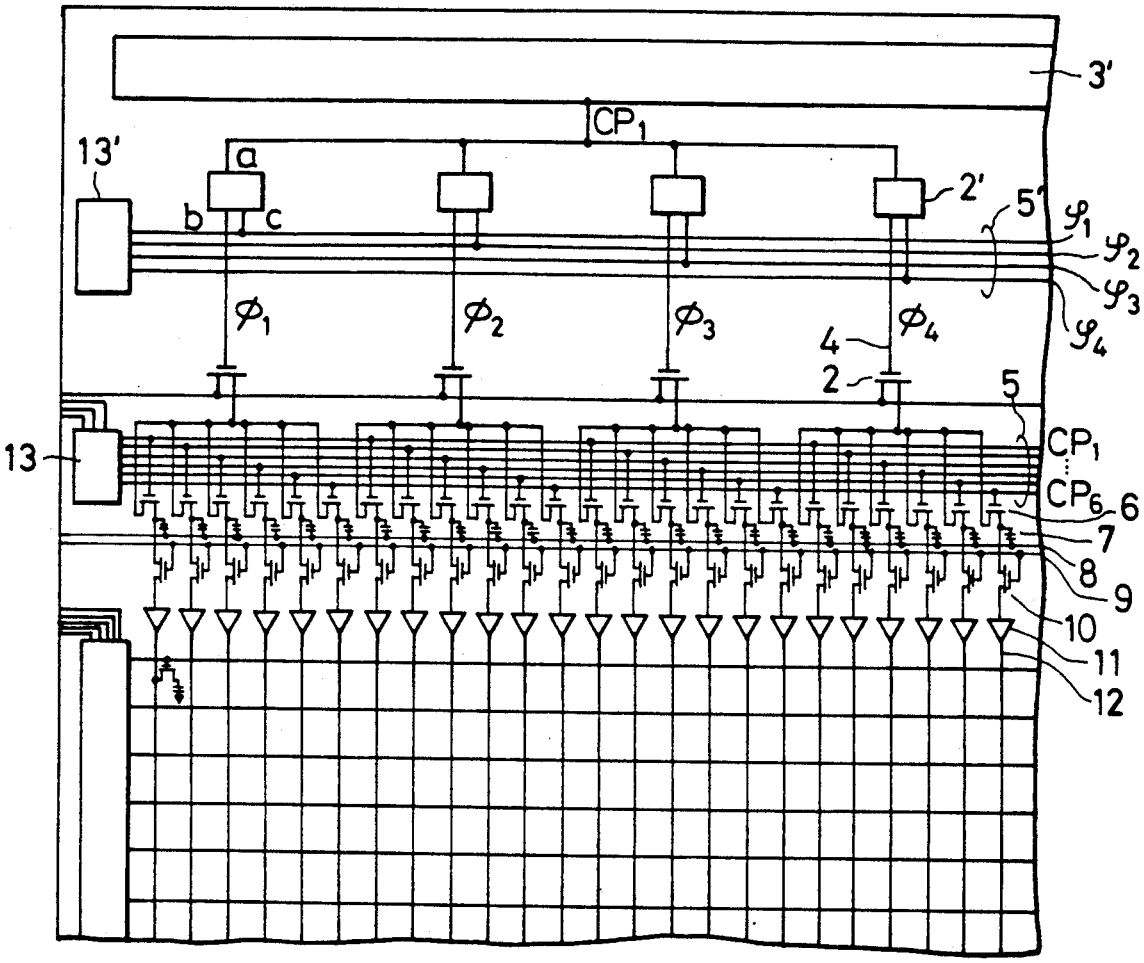
FIG. 23(*a*) illustrates yet another embodiment of the present invention including structures for generating scanning voltages.
Figure 23B:
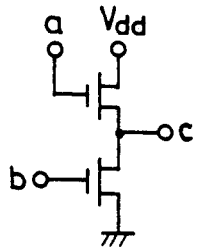
Figure 23C:
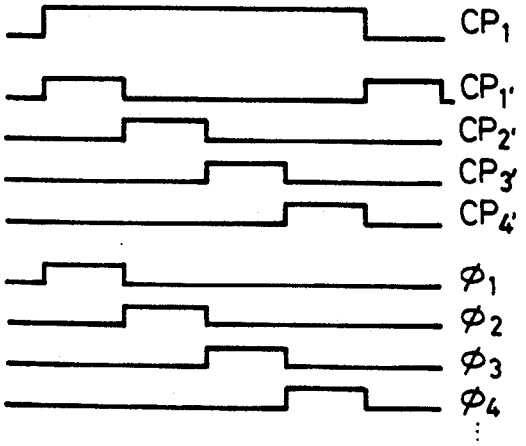

FIG. 23(*a*) shows a structure for generating the scanning voltages $\phi_1$, $\phi_2$, $\phi_3$, - - - , and so on from the outputs $\zeta_1$, $\zeta_2$, - - - , and so on of a scanning voltage generator 3' by combining multi-phase clock wirings 5' and switch circuits 2'. An example of the switch circuits 2' conceivable is to generate an output voltage c from two-phase clocks a and b by two TFT elements, as shown in FIG. 23(*b*).

The driving waveforms are presented in FIG. 23(*c*). The scanning voltages $\phi_1$, $\phi_2$, $\phi_3$ and $\phi_4$ are generated by switching the output $\zeta_1$ with four-phase clock pulses $CP_1'$, $CP_2'$, $CP_3'$and $CP_4'$.

Figure 11:
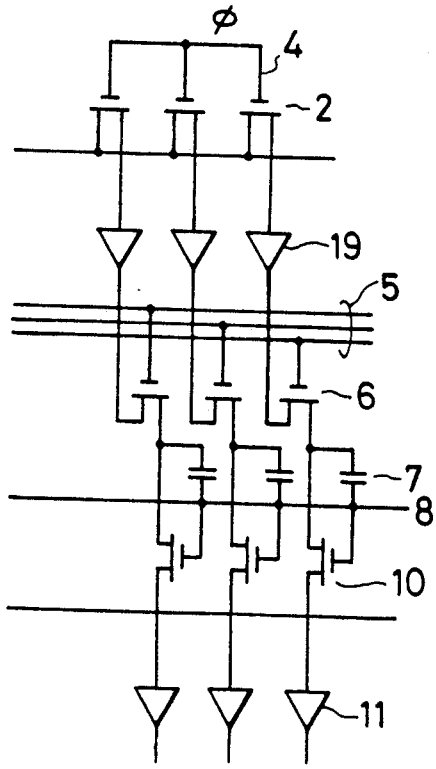
FIG. 11 discloses yet another embodiment of the present invention including a modification of the circuit of FIG. 1.

FIG. 11 shows a modification of the circuit structure of FIG. 1. In this modification, buffer circuits 19 are disposed at the output stages of the TFT elements 2 to amplify the voltages. Thus, the buffer circuits can be inserted for the purposes of voltage amplification, level shift and so on.

Figure 12:
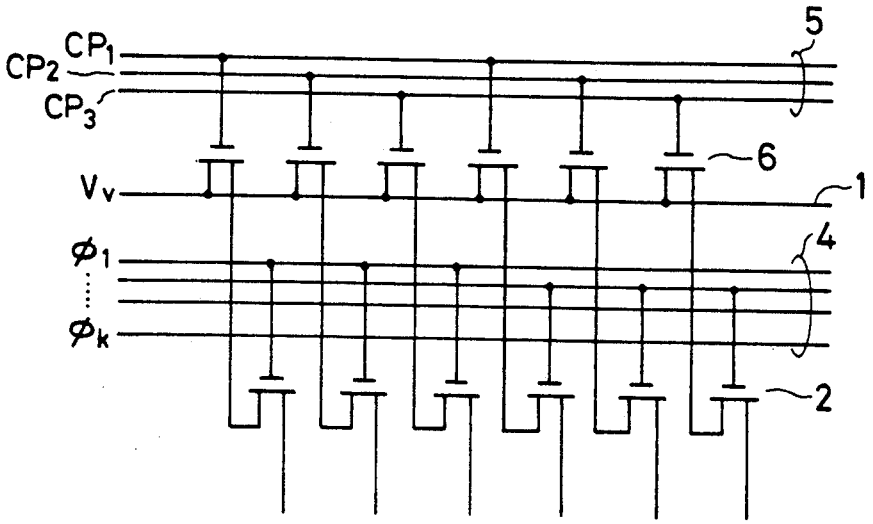
FIG. 12 illustrates a circuit diagram for yet another embodiment of the present invention.

FIG. 12 shows the structure in which the sampling TFTs 6 are connected with the signal input wiring and in which the scanning wirings 4 and the TFTs 2 are connected with the output stages of the TFTs 6. The operations of the circuit are similar to those of the circuit of FIG. 1. In this case, however, the voltages held in the electrostatic capacitors connected with the output stages of the TFT elements 2 are influenced by the voltages applied to the gate voltages by the gate-source capacitors of the TFT elements, the clock pulses $CP_1$, $CP_2$, and $CP_3$ have higher frequencies than the scanning voltages $\phi_1$, $\phi_2$, - - - , and so on. Hence, the structure of FIG. 7 is advantageous in that it is less influenced by the gate voltages. It goes without saying that the driving methods of FIGS. 4, 5 and 6 can be applied to the embodiment of FIG. 12.

Figure 13:
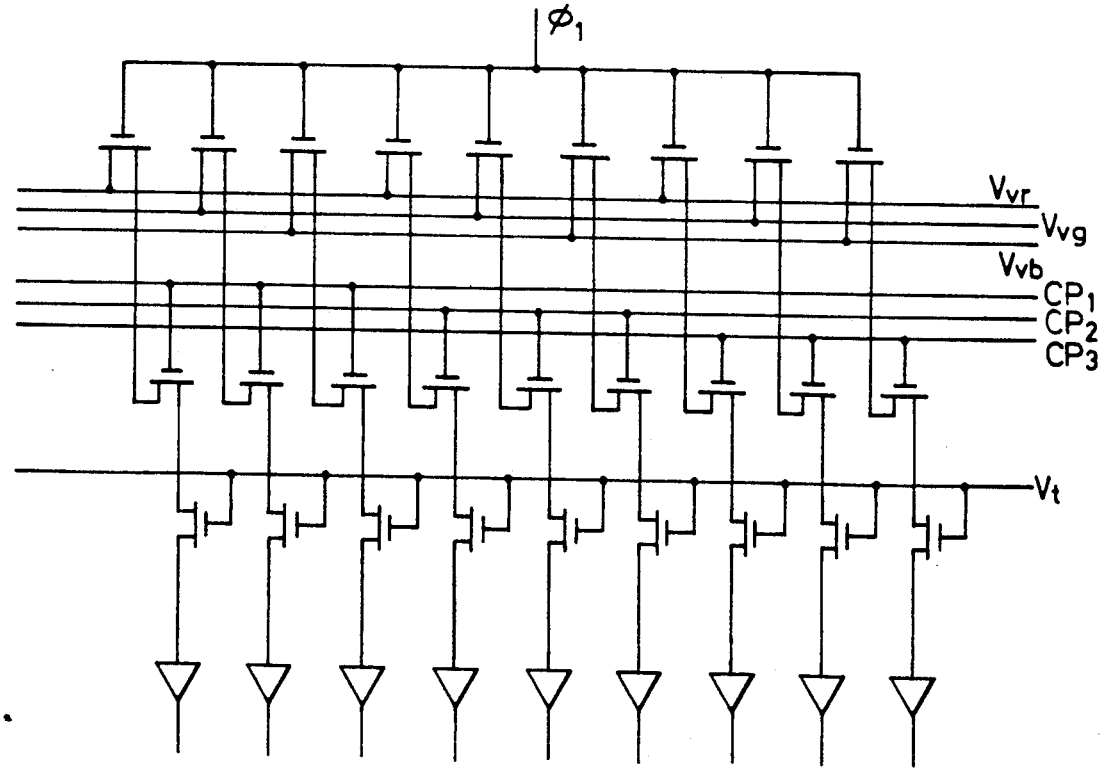
FIG. 13 illustrates a circuit diagram for yet another embodiment of the present invention.

FIG. 13 shows an example of the structure in case the circuit of FIG. 1 corresponds to the three color input signal wirings 1. Nine TFT elements are grouped into one block for the video signals $V_{vr}$, $V_{vg}$ and $V_{vb}$ corresponding to the display of three colors and are sampled with the three-phase clock voltages $CP_1$, $CP_2$ and $CP_3$ . With this structure, it is possible to drive nine pixels (corresponding to three dots, if the three colors R, G and B constitute one dot). The color arrangement of a mosaic structure can be displayed by changing the order in which the video signals $V_{vr}$, $V_{vg}$ and $V_{vb}$, are to be applied for each line.

Figure 14:
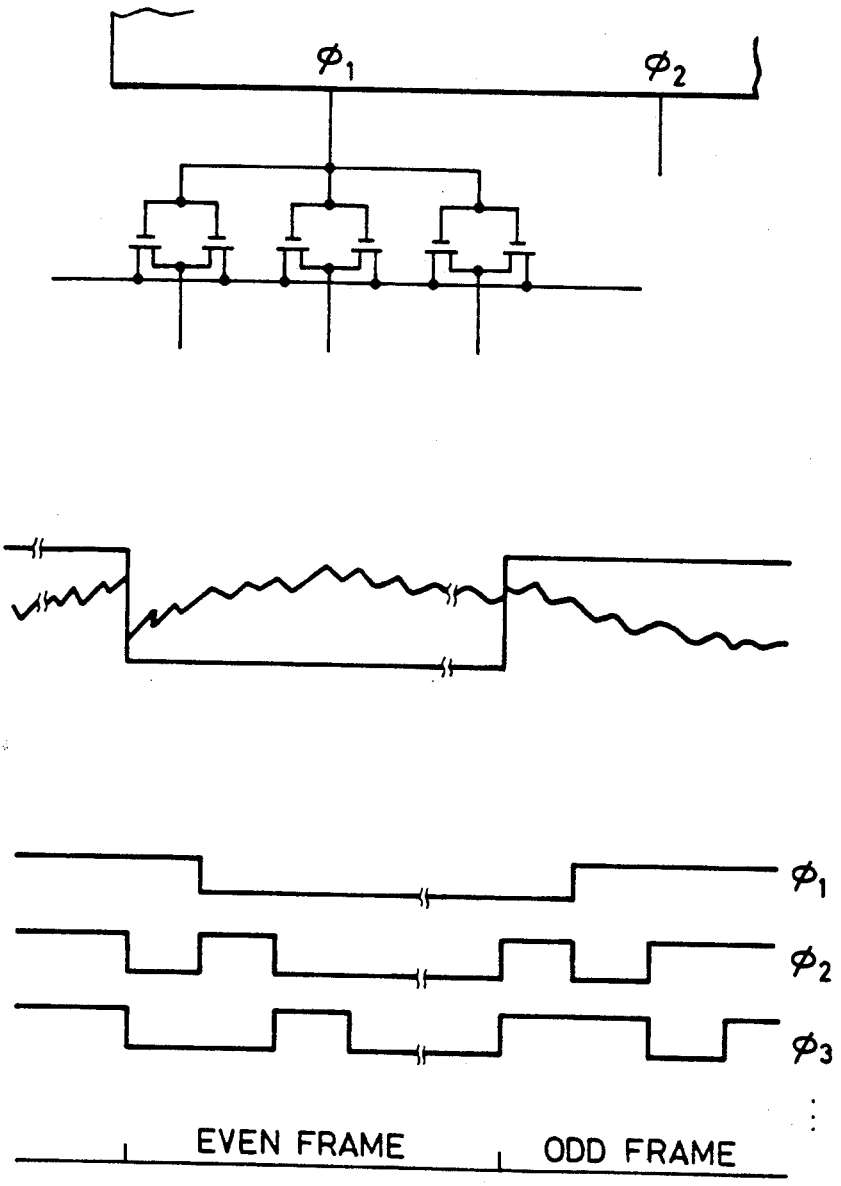
FIG. 14 illustrates a circuit diagram of p and n channel CMOS switches.

FIG. 14 shows one example of the circuit structure using p- and n-channel CMOS switches and the driving waveforms of the circuit. In order to invert the polarities of the signal voltages for each line or frame, it is necessary to supply voltages of both positive and negative polarities For this necessity, the switches can be constructed by the use of both p- and n-channel TFT elements to improve the operating speed.

Figure 15:
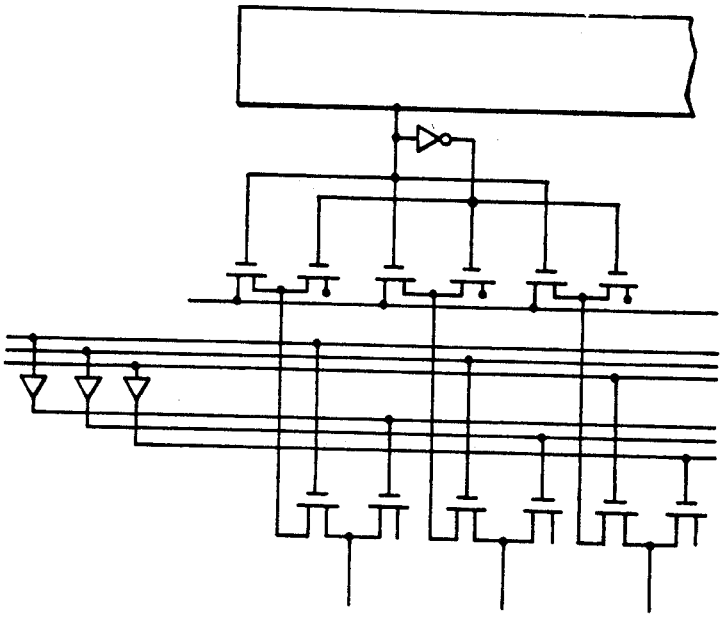
FIG. 15 illustrates a circuit diagram for yet another embodiment of the present invention.

FIG. 15 shows a method for preventing the voltages of the gates from being superposed on the sources due to the capacitive coupling by the gate-source electrostatic capacitors of the TFT elements. Each of the TFTs thus far described is replaced by two TFT elements, one of which applies the voltage of inverted logic to the gates to offset the capacitive coupling of the gates.

Figure 16:
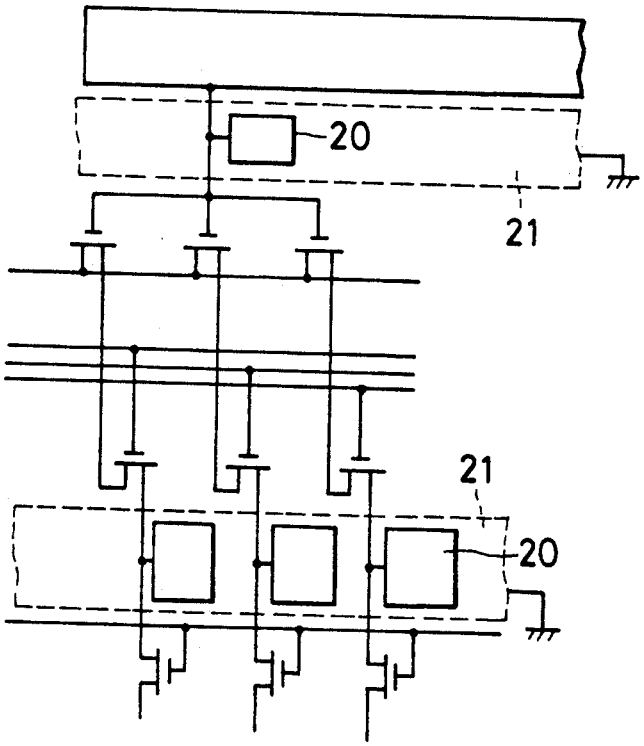
FIG. 16 illustrates an embodiment of the present invention in which electro-static capacitors act as a capacitive loads.

FIG. 16 shows one example of forming the electrostatic capacitors acting as the capacitive loads. It is the current practice to form the electrostatic capacitors of two layers of metal electrodes and one layer of insulating film. In this example, however, a transparent electrode such as an electrode 21 is formed on a glass substrate opposed to the TFT substrate, and electrodes 20 are also formed on the portions of the TFT substrate requiring the electrostatic capacitors. Electrostatic capacitors having excellent characteristics can be formed between those two sheets of electrodes by confining a liquid crystal when the display is formed. If, in addition, those two sets of electrodes are made of transparent ones, the voltage are applied when in the circuit operations so that the liquid crystal operates to make it possible to test the operations of the circuit.

Figure 17:
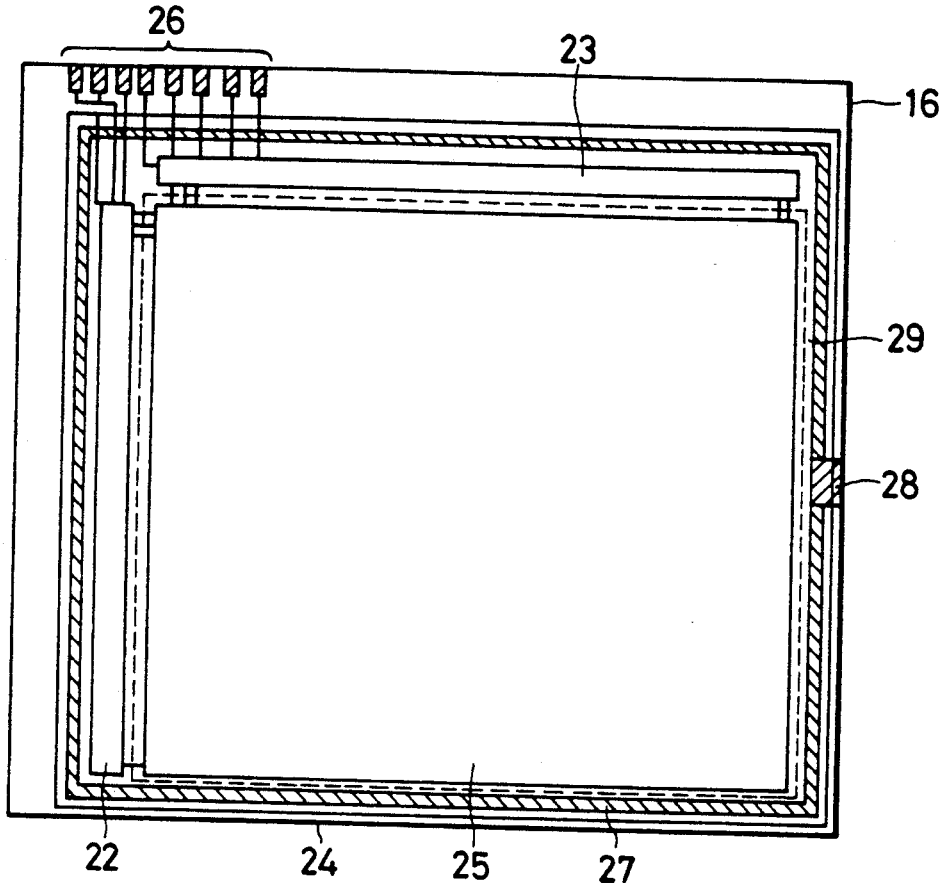
FIG. 17 illustrates yet another embodiment of a configuration for forming electro-static capacitors.

In addition to FIG. 16, in order to stabilize the circuit operations thus far described, an example, in which the transparent electrodes are removed from the opposed substrate on the circuit forming portions except the case in which the opposed glass electrodes as shown in FIG. 12 are to be used as the electrodes for forming the electrostatic capacitors, is shown in FIG. 17. A transparent electrode region 29 on an opposed glass substrate 24 is formed only on a display unit 25 but not on a scanning circuit 22 and a signal circuit 23. As a result, the circuit can be speeded up by reducing the electrostatic capacitive coupling between the individual portions of the circuit and the opposed glass substrate.

Figure 24:
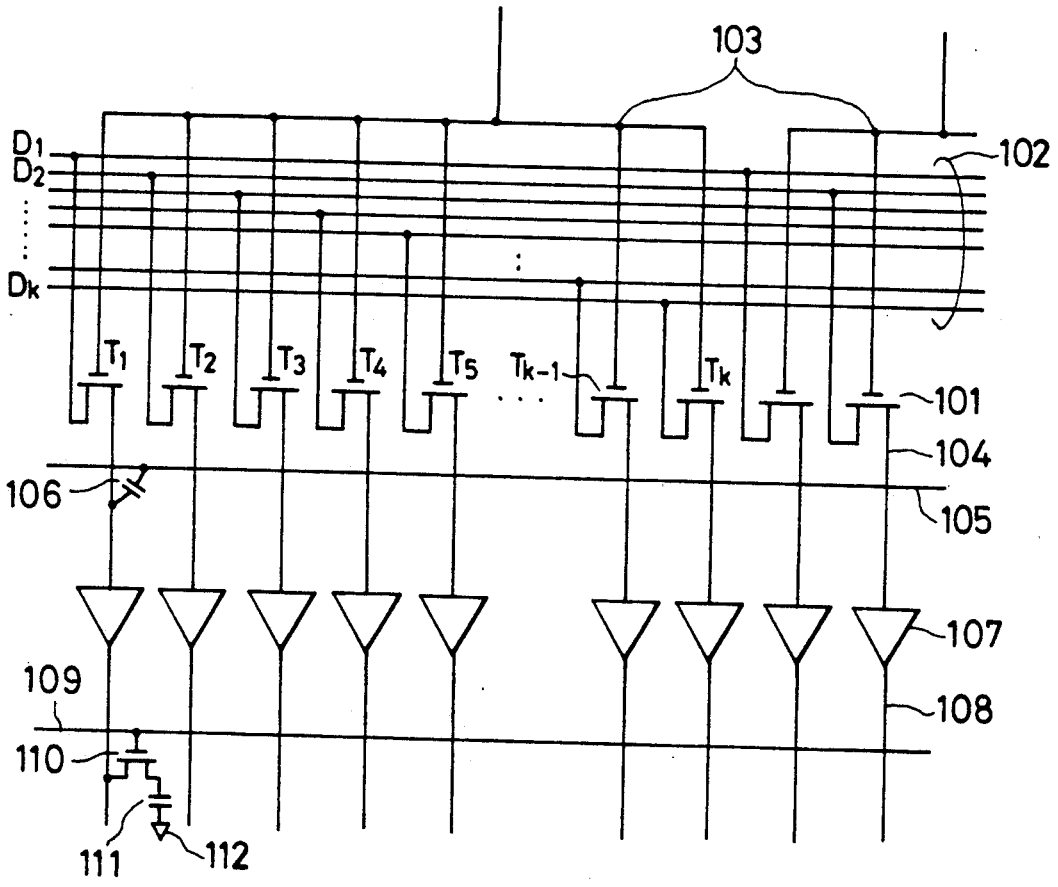
FIG. 24 illustrates a circuit diagram for yet another embodiment of the present invention.

FIG. 24 shows a modification of the circuit of FIG. 1. A plurality of TFT elements 101 are arrayed such that a k-number of TFT elements have their drain electrodes connected with a k-number of data electrodes 102, respectively, and their gate electrodes connected with one block scanning electrode 103. Output electrodes 104 connected with the source electrodes of the k-number of TFT elements are connected with buffer circuits or voltage converters 107 to output voltages at signal electrodes 108 of a display unit. In the present embodiment, the data electrodes 102 are arranged at the input side of the TFT elements 101 but do not intersect the output electrodes 104. Moreover, the buffer circuits 107 are formed between the output electrodes 104 and the display unit, and a scanning electrode 109 of the display unit and the output electrodes 104 do not intersect. With this structure, it is possible to avoid the voltages, which have their levels always varying with time like the data signal voltages or the scanning voltage of the display unit with respect to the output electrodes 104 of the TFT elements 101, from being superposed as noises on the signal voltages by the electrostatic capacitive coupling Even if the TFT elements 101 are constructed to have a small shape, moreover, the S/N ratio of the signal voltages can be increased.

In addition to the structure thus far described, a capacitive electrode 105 can be made to intersect the output electrodes 104 while interposing an insulating film to form a built-in capacitor 106, thereby increasing the stability of the output voltages applied by the TFTs 101.

The buffer circuits 107 may be the so-called "multiplexer circuit" for selecting the output voltages from voltages at a plurality of levels, or a circuit having a high impedance at its input side and a low impedance at its output side, such as an analog voltage amplifier.

According to the embodiment of FIG. 24, the fluctuations of the waveforms due to the capacitive coupling to other wirings can be reduced at the output portion of the divided matrix circuit so that a stable output voltage can be obtained to improve the display characteristics of the display unit. Thanks to the small fluctuations of the waveforms due to the capacitive coupling to the output portion, moreover, the capacitances to be established at the output portion can be reduced to a small value, and the TFT elements of the driving divided matrix circuit can be made small while improving the operating speed of the divided matrix circuit.

Incidentally, the embodiments thus far described are exemplified by the sequential line scanning method. Despite this fact, however, naturally the present invention can be applied to the sequential dot scanning method.

According to the present invention, it is possible to provide the high-speed scanning method and circuit.

What is claimed is:

1. A signal circuit for feeding display data signals to a display, comprising:

an input line receiving display data signals;

a signal input sampling circuit connected to said input terminal and comprising, a first control circuit producing a first plurality of control signals;

a first switching circuit, said first switching circuit being responsive to said first plurality of control signals;

a second control circuit producing a second plurality of control signals;

a second switching circuit, coupled to said first switching circuit and having a plurality of output lines, wherein said display data signals appear at ones of said plurality of output lines in accordance with a timing defined by said first plurality of control signals and said second plurality of control signals;

a hold circuit coupled to each of said plurality of output lines;

a data transfer circuit connected to each of said plurality of output lines; and a display unit driver coupled to said data transfer circuit, wherein said first switching circuit comprises n switching devices, where n is an integer $\geqq 2$ and wherein, each switching device has an input terminal, an output terminal and a control terminal;

the input terminal of each of said n switching devices is coupled to said input line;

the control terminal of each of said n switching devices is coupled to said first control circuit and receives one of said first plurality of control signals that is associated with the given one of said n switching devices; and the display data signals appear at the output terminals of said n switching devices with a timing defined by said first plurality of control signals, wherein said second switching circuit comprises m switching devices, where m is an integer and is defined by $s \times n$, where s is an integer $\geqq 1$, each of said m switching devices having an input terminal, an output terminal and a control terminal, said input terminal of each of said m switching devices is coupled to an output terminal of an associated one of said n switching devices, said output terminal of each of said m switching devices is coupled to said holding circuit and said data transfer circuit, and said control terminal of each of said m switching devices is coupled to said second control circuit and receives one of said second plurality of control signals that is associated with the given one of said m switching devices, wherein at least two of said n switching devices are on at the same time as controlled by said first plurality of control signals and at least two of said m switching devices are on at the same time as controlled by said second plurality of control signals.

2. The signal circuit of claim 1 wherein said holding circuit comprises a plurality of capacitive loads, where a capacitive load is associated with each of said m plurality of switching devices.

3. The signal circuit of claim 1 wherein said data transfer circuit comprises a third plurality of further switching devices, wherein said third plurality comprises m further switching devices, one for each of said m switching devices of said second switching circuit.

4. The signal circuit of claim 1 wherein all of said m and n switching devices comprise thin film transistors.

5. The signal circuit of claim 3 wherein all of said m and n switching devices, and said m further switching devices comprise thin film transistors.

6. A signal circuit for feeding display data signals to a display, comprising:

an input line receiving display data signals;

a signal input sampling circuit connected to said input terminal and comprising, a first control circuit producing a first plurality of control signals;

a first switching circuit, said first switching circuit being responsive to said first plurality of control signals;

a second control circuit producing a second plurality of control signals;

a second switching circuit, coupled to said first switching circuit and having a plurality of output lines, wherein said display data signals appear at ones of said plurality of output lines in accordance with a timing defined by said first plurality of control signals and said second plurality of control signals;

a hold circuit coupled to each of said plurality of output lines;

a data transfer circuit connected to each of said plurality of output lines; and a display unit driver coupled to said data transfer circuit;

wherein said first switching circuit comprises n sets of y switching transistors where n and y are integers $\geqq 2$ and wherein, each switching device has an input terminal, an output terminal, and a control terminal;

the control terminal of each of said y switching devices of one of said n sets of switching devices is coupled to said first control circuit to receive the same one of said first plurality of control signals associated with that set of switching devices;

the input terminal of each of the $n \times y$ switching devices is coupled to said input line; and the display data signals appear at the output terminals of said $n \times y$ switching devices with a timing defined by said first plurality of control signals.

7. The signal circuit of claim 6 wherein said second switching circuit comprises m switching devices, where m is an integer and is defined by $s \times n \times y$, where s is an integer $\geqq 1$, each of said m switching devices having an input terminal, an output terminal and a control terminal;

said input terminal of each of said m switching devices is coupled to an output terminal of an associated one of said $n \times y$ switching devices;

said output terminal of each of said m switching devices is coupled to said holding circuit and said data transfer circuit, and said control terminal of each of said m switching devices is coupled to said second control circuit and receives one of said second plurality of control signals that is associated with a given one of said m switching devices.

8. The signal circuit of claim 7 wherein said holding circuit comprises a plurality of capacitive loads, where a capacitive load is associated with each of said m plurality of switching devices.

9. The signal circuit of claim 7 wherein said data transfer circuit comprises a third plurality of further switching devices, wherein said third plurality comprises m further switching devices, one for each of said m switching devices of said second switching circuit.

10. The signal circuit of claim 7 wherein all of said m and n switching devices comprise thin film transistors.

11. The signal circuit of claim 9 wherein all of said m and n switching devices, and said m further switching device comprise thin film transistors.

12. An input signal sampling circuit in a driving circuit for displaying data signals, comprising:

an input line;

a first control circuit producing 1 control signals where 1 is an integer $\geqq 2$;

a first switching circuit coupled to said input line and said first control circuit and receiving said 1 control signals, said first switching circuit further including a plurality of output lines;

a second control circuit producing a plurality of second control signals; and a second switching circuit, coupled to said second control circuit and said plurality of output lines of said first switching circuit, wherein said first switching circuit comprises 1 sets of switching devices where each of said 1 sets includes n switching devices where n is an integer $>1$, such that the total number of switching devices in said first switching circuit is $n \times 1$;

each of said $n \times 1$ switching devices has an input terminal coupled to said input line, a control terminal coupled to said first control circuit, and an output terminal coupled to said second switching circuit such that each of said 1 sets of switching devices is associated with one of said 1 first control signals;

wherein said second switching circuit comprises m switching devices where m is an integer defined by $s \times n \times 1$ where s is an integer $>1$ and wherein each of said m switching devices comprises an input terminal coupled to an output terminal of one of said $n \times 1$ switching devices;

wherein said second control circuit produces at least n control signals each being supplied to different ones of said m switching devices; and wherein at least two of said n control signals have a first value at the same time, wherein when the said first value is applied to a control terminal of one of said m switching devices, said one switching device passes a signal on its input terminal to its output terminal.

* * * * *

UNITED STATES PATENT AND TRADEMARK OFFICE

CERTIFICATE OF CORRECTION

PATENT NO. : 5,021,774

DATED : June 4, 1991

INVENTOR(S) : Jun-ichi OHWADA et al.

It is certified that error appears in the above-identified patent and that said Letters Patent is hereby corrected as shown below:

| Column | Line | |
|---|---|---|
| 2 | 43 | Change "106 Hz" to --$10^6$ Hz--. |
| 2 | 51 | After "thereby" delete "to". |
| 3 | 2 | Before "higher" delete "the". |
| 4 | 20 | After "of" insert --the--. |
| 4 | 45 | Delete "a". |
| 5 | 2 | After "connection" insert --with--. |
| 5 | 54 | Before "remains" delete "is". |
| 6 | 19 | Change "vary" to --varies--. |
| 6 | 55 | Befoore "glas" delete "as". |
| 7 | 39 | After "circuit" insert --.--. |
| 10 | 26 | Before "structure" insert --a--. |
| 10 | 44 | Change "as" to --which--. |
| 10 | 65 | Change "showing" to --shows--. |
| 10 | 68 | Change "FiG." to --FIG.--. |

UNITED STATES PATENT AND TRADEMARK OFFICE

CERTIFICATE OF CORRECTION

PATENT NO. : 5,021,774

DATED : June 4, 1991

INVENTOR(S) : Jun-ichi OHWADA et al.

It is certified that error appears in the above-identified patent and that said Letters Patent is hereby corrected as shown below:

| Column | Line | |
|---|---|---|
| 12 | 10 | Change "voltage" to --voltages--. |

Signed and Sealed this

Fifth Day of January, 1993

*Attest:*

DOUGLAS B. COMER

*Attesting Officer*

*Acting Commissioner of Patents and Trademarks*